US005660923A

United States Patent [19]

Bieler et al.

[11] Patent Number: 5,660,923

[45] Date of Patent: Aug. 26, 1997

[54] METHOD FOR THE PREPARATION OF METAL MATRIX FIBER COMPOSITES

[75] Inventors: Thomas R. Bieler; Viswanadha R. Yallapragada, both of East Lansing, Mich.; Huizhong Wang, Beijing, China; Lawrence T. Drzal, Okemos, Mich.

[73] Assignee: Board of Trustees operating Michigan State University, East Lansing, Mich.

[21] Appl. No.: 332,575

[22] Filed: Oct. 31, 1994

[51] Int. Cl.[6] ..... B32B 5/16

[52] U.S. Cl. ..... 442/377; 264/131; 264/257; 427/191; 427/192; 427/294; 427/370; 427/383.3; 428/402; 428/408; 428/902

[58] Field of Search ..... 428/283, 288, 428/297, 402, 408, 902; 264/131, 171.13, 257; 427/191, 192, 294, 370, 383.3

[56] References Cited

U.S. PATENT DOCUMENTS

| | | | |
|---|---|---|---|
| 5,042,111 | 8/1991 | Drzal et al. | 19/65 T |
| 5,042,122 | 8/1991 | Drzal et al. | 22/283 |
| 5,123,373 | 6/1992 | Drzal et al. | 118/312 |
| 5,128,199 | 7/1992 | Drzal et al. | 428/240 |
| 5,310,582 | 5/1994 | Drzal et al. | 427/560 |

OTHER PUBLICATIONS

Mortensen, A., et al, Journal of Metals, Feb. 1988, 12–19.

Bader, M.G., et al., Composites Science and Technology 23 287–301 (1985).

Kohara, S., et al., Composites '86: Recent Advances in Japan and the U.S., eds. K. Kawata et al Proceedings of Japan–U.S. CCM–III, Tokyo, 491–496 (1986).

Erich, D.L., Int. J. Powder Metallurgy, 23 45–54 (1987).

Shimizu, J., et al., Metal & Ceramic Matrix Composites Proc. Modeling & Mech. Behav., eds. R.B. Bhagat et al. 31–38 (1990).

Arsenault, R.J., Mat. Sci. and Eng. 64 171–181 (1984).

Aluminum Association Handout, "Recommendation for Storage and Handling of Aluminum Powders and Paste", TR–2.

Weeton, J.W., et al., Engineers' Guide to Composite Materials, Carnes Pub. Services, USA 1987.

Woodthorpe, J., et al., J. Mater. Sci, 24 1038 (1989).

Wright, J.K., et al., J. Am. Ceram. Soc. 72(10) 1822 (1989).

*Primary Examiner*—James J. Bell

*Attorney, Agent, or Firm*—Ian C. McLeod

[57] ABSTRACT

A method for producing continuous and discontinuous fiber metal matrix composites (CFMMC). The method uses aerosolization of finely divided metal powders in a controlled atmosphere which prevents explosions to coat the fibers and then the metal coated fibers are consolidated to form the CFMMC. The composites are useful as heat sinks for electrical components and in applications where a structural reinforced metal matrix composite is needed.

21 Claims, 22 Drawing Sheets

Example 1 (Sample A)

Example 1 (Sample B)

Example 1 (Sample A)

Example 1 (Sample B)

Example 1 (Sample A)

40μm

Example 1 (Sample B)

20μm

Example 1 (Sample A)

20μm

Example 1 (Sample B)

Example 2 Fractographs

Example 2 Fractographs

METHOD FOR THE PREPARATION OF METAL MATRIX FIBER COMPOSITES

BACKGROUND OF THE INVENTION

1. Field of the Invention

The present invention relates to a method for the preparation of metal matrix fiber composites. In particular, the present invention relates to a method which produces metal powders uniformly coated on fibers as a result of aerosolization of the powders and then consolidation of the powder on the fibers to form the matrix.

2. Description of Related Art

Fabricating metal matrix composites with fiber tows surrounded by the metal matrix has always presented difficulties to materials producers. Unlike the viscous polymers, liquid metals have a viscosity similar to water. (Mortensen, A., et al, Journal of Metals, 30 (1986)). If the fiber can be wetted by the matrix material, a liquid-infiltration technique could be a first choice because of simplicity and continuity. If the fiber is not wetted by the metal, a suitable fiber coating or matrix alloying addition had to be found to facilitate wetting. In either case, interfacial reaction between the metal and the fiber is hard to control due to overexposure to molten metal. Uneven fiber distribution in the metal matrix is also an unsolved problem. The problems encountered with liquid phase processes are 1) porosity from solidification shrinkage (opening voids between the fibers), 2) low fiber volume fraction, 3) interface reaction degradation, and 4) uneven distribution of fibers. Most of the problems arise from the difficulty in wetting the fiber with the liquid metal.

The problems are reduced with squeeze casting into a mold with a preform of fibers (Bader, M. G., et al., Composites Science and Technology 23 287–301 (1985); and Kohara, S., et al., Composites '86: Recent Advances in Japan and the United States, eds. K. Kawata, S. Umekawa and A. Kobayashi, (Proceedings of Japan-U.S. CCM-III, Tokyo, 491–496 (1986)). However the problems increase as the fiber diameter decreases. Alloy additions can reduce the wetting contact angle with the fibers; however, they also cause more interface reactions, which usually degrades the bond or the integrity of the fiber (Mortensen, A., et al., Journal of Metals, p. 30 (March 1986)). Other methods, such as electroplating, spraying, chemical vapor deposition and physical vapor deposition, could produce high quality composites, but the methods are time consuming and expensive. Plasma spraying coats fibers with a liquid metal, which can later be arranged in a desirable way, can be accomplished but only with large (140 μm) diameter plasma sprayed fibers. Furthermore, these known techniques are generally not suitable for commercial large-scale or continuous processing.

Powdered metal processing with fibers eliminates or reduces the interface wetting/reaction problem with liquid processing. The metal is sintered and forms around the fiber in the solid state. The kinetics for interface reactions are much slower in powder methods. The two major problems of this strategy are 1) fiber damage may occur under the pressure needed for consolidation (Erich, D. L., Int. J. Powder Metallurgy, 23 45–54 (1987), and 2) high fiber volume fractions are not possible, if large or agglomerated powder particles are present, since they cause the fibers to bunch up (Shimizu, J., et al., Metal & Ceramic Matrix Composites: Processing Modeling & Mechanical Behavior, eds. R. B. Bhagat, A. H. Clauer, P. Kumar and A. M. Ritter, (TMS/AIME Warrendale Pa.) 31–38 (1990)).

Fibers can be manually arranged between layers of foil and hot pressed. There are a limited number of foil compositions available and the volume fraction of fibers is often small, and the fiber diameters are large (Mortensen, A., et al., Journal of Metals, p. 30 (March 1986)). These processes often provide dramatically better properties than predicted by continuum models of discontinuous fibers, since dislocations generated near the interface deflect cracks and change matrix properties near the interface, due to strains from thermal expansion mismatch (Erich, D. L., Int. J. Powder Metallurgy, 23 45–54 (1987); and Arsenault, R. J., Mat. Sci. and Eng. 64 171–181 (1984)).

A continuous fiber-reinforced polymer matrix composite method was originally developed by Drzal et al (U.S. Pat. Nos. 5,042,122, 5,042,111, 5,123,373, 5,128,199, and 5,310, 582). In the Drzal et al method, an unsized carbon fiber tow goes through different chambers to make a prepreg tape of a polymer matrix composite. A fiber tow is driven by a motor from a fiber spool to pass above a speaker. The sound waves coming off the speaker spread the fibers apart. The spread fibers are held in position by ten stainless steel shafts spaced one inch apart and placed on the top of the speaker. After spreading, the fibers pass through an optional pre-treatment chamber to modify the fiber surface or to apply a thin coating of binder material to improve adhesion with the matrix. Then, the fibers enter an impregnation chamber, called aerosolizer, where small polymer particles (about 10 microns in diameter) are suspended by the effect of a vibrating rubber membrane placed on top of a speaker, which works as a bed of polymer powders. The powders are attached to the fibers by an electrostatic force generated from the static charges held by the fine polymer particles. After coating with polymer particles, the fibers pass through the oven chamber for about 15 seconds. The particles are heated by convection and radiation until sintering occurs between adjacent particles to form a thin film. The impregnated fibers are then cooled and wound on a take up drum. After a run, the resulting prepreg tape is cut into pieces to a desired length and are laid-up in a rectangular stainless steel mold for hot pressing according to a pressure-temperature-time profile. A sheet of continuous fiber-reinforced polymer matrix composite material is thus formed and is evaluated. The problem is to provide a continuous fiber metal matrix composite (CFMMC).

Finely divided metal powders are explosive in an atmosphere containing any oxygen and thus the aerosolization of powders in air has not been considered to be useful as a method for coating fibers. Serious problems are created by the use of aerosolized powders which have not been solved by the prior art.

OBJECTS

It is therefore an object of the present invention to provide a method for producing a continuous fiber reinforced metal matrix composite. It is further an object of the present invention to provide a method wherein the problem of non-wetting of the fibers is eliminated and wherein the destructive interaction between the metal matrix and the fibers is minimized. Further still, it is an object of the present invention to provide a method using metal powders which is safe and economical. These and other objects will become increasingly apparent by reference to the following description and the drawings.

IN THE DRAWINGS

FIG. 1 is a schematic view of a system 10 used to process continuous fibers to produce a continuous fiber metal matrix composite 100 (CFMMC). The system 10 includes a fiber spool 11, speaker spreader 12, optional pretreatment chamber 13, polymer coating chamber or aerosolizer 14, heater 15 and take up drum 16 of the Drzal et al patents. The new metal powder aerosolization apparatus 20, furnace 40, and consolidation rolls 50 are provided for forming the CFMMC 100.

FIG. 2 is a schematic cross-sectional view of the metal powder coating apparatus 20, particularly showing an aerosolization inside tube 24 adapted to prevent explosion of the aerosolized metal powder. FIG. 2A is a partial enlarged section of FIG. 2 showing the mounting of the membrane 25.

FIGS. 3A shows a confinement tube 21 for the aerosolization apparatus 20. FIG. 3B is a side view of the shape of the bottom lid 27. FIG. 3C is a plan view of the top lid 28 showing entry ports 28A and which otherwise is the same as the bottom lid 27.

FIG. 4 is a front view of the inside tube 24, partially showing an o-ring groove 24A, gas inlet 29 and outlet 30 and tungsten pins 24B for electrical connection.

FIG. 5 is a front view of the inside tube 24 showing the mounting of a heater 31 inside the tube 24 and section of prepreg tape 32 mounted inside the heater 31.

FIG. 6 is a schematic view of a vacuum system 60 for the inner tube 24 and the connections 72 to 75 through the cover 28 of outer tube 21.

FIG. 7 is a front view of simple beam subjected to three-point bending for test purposes.

FIGS. 8A to 19B relate to Example 1.

Figure 22:
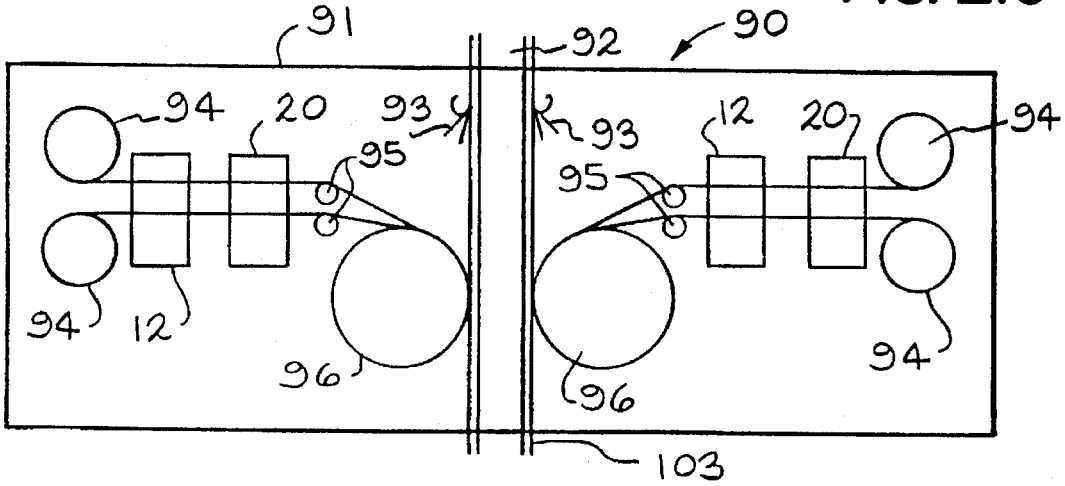
Figure 23:
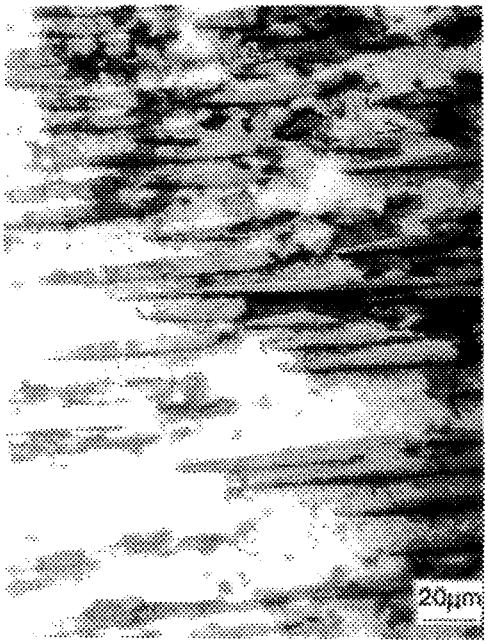
Figure 24:
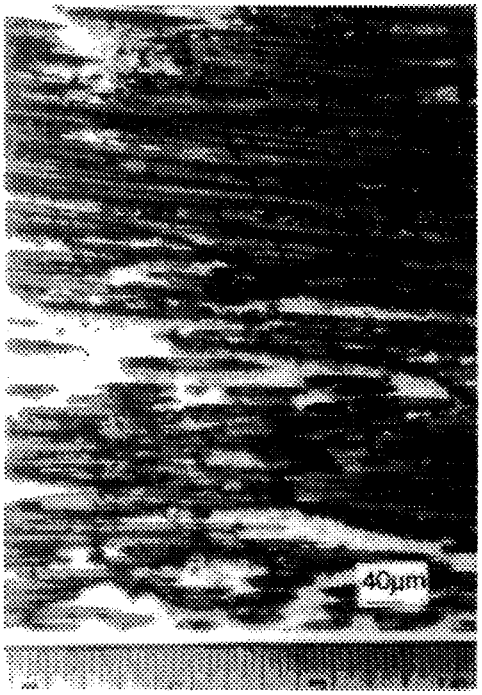
Figure 25:
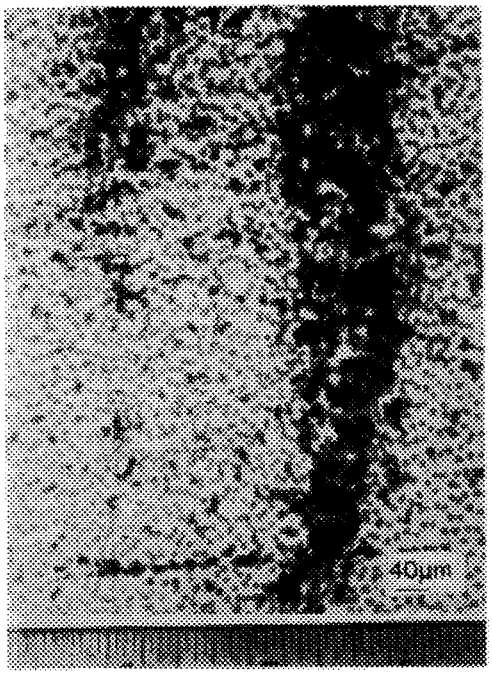

FIG. 22 is a schematic front view of another system 90 for incorporating a metal matrix 103 onto a core 92 for consolidation.

FIGS. 23 to 26 are optical microscopic micrographs of transverse and longitudinal sections of a composite product prepared without the use of a binder as in Example 3.

Figure 27:
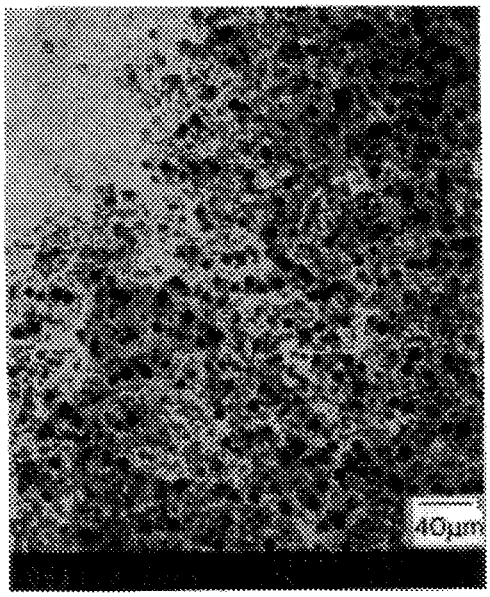
Figure 28:
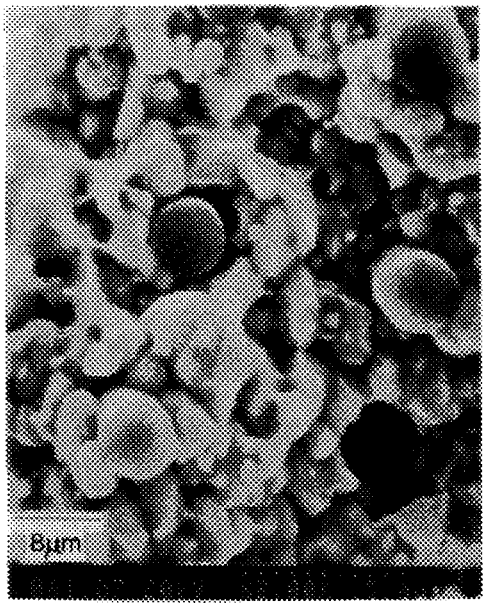

FIGS. 27 and 28 show scanning electron microscope (SEM) micrographs of sections resulting from fracture of a specimen.

DESCRIPTION OF PREFERRED EMBODIMENTS

The present invention relates to a method for forming a composite product which comprises:

(a) providing fibers coated with particles of an oxidizable metal containing powder; and (b) pressing the powder coated fibers in a heated press so that the particles of the metal containing powder consolidate with the fibers to form the composite product.

Further the present invention relates to a method for forming a composite product which comprises:

(a) introducing a tow of fibers coated with beads of a polymer into a closed chamber containing particles of an oxidizable metal containing powder to be coated onto the fibers in a controlled atmosphere which prevents uncontrolled oxidation of the metal containing powder;

(b) aerosolizing the powder in the chamber in the controlled atmosphere so as to coat the particles on the polymer and fiber;

(c) removing the particle coated tow of fibers from the chamber; and (d) consolidating the particle coated tow of fibers in a heated press so that the metal powder sinters and flows together and forms a matrix around the fibers to provide the composite product.

Finally the present invention relates to a method for forming a composite product which comprises:

(a) introducing a tow of fibers into a closed chamber containing particles of an oxidizable metal containing powder to be coated onto the fibers in a controlled atmosphere which prevents uncontrolled oxidation of the metal containing powder;

(b) aerosolizing the powder in the chamber in the non-reactive atmosphere so as to coat the particles on the fibers;

(c) removing the particle coated tow of fibers from the chamber; and (d) consolidating the particle coated tow of fibers in a heated press so that the metal containing powder sinters together and forms a matrix around the fibers to provide the composite product.

The fibers can be inorganic or organic so long as they can be consolidated with heating to form the metal matrix. Such fibers are composed of for instance carbon, glass, ceramic, such as silicon carbide, aluminum oxide and boron, and metals.

The metal powders are preferably Al, Ti, Cu, Be, Mg and alloys thereof. Preferred is aluminum and alloys thereof because of weight considerations. Metal containing powders with polymer powders or ceramic powders can also be used so long as they aerosolize and consolidate.

The controlled atmosphere for the aerosolization is usually provided by a non-reactive gas such as argon, helium, nitrogen and the like. Argon is preferred since it is readily available.

If a polymer coating is used as a binder for the metal particles it is removed. Usually a vacuum furnace is used. The vacuum and the elevated temperature are first sufficient to remove the polymer coating and then to melt the metal to form the matrix. For aluminum powder and carbon fibers the temperature is between 500°–600° C. All of these variations will be obvious to one skilled in the art.

Figure 1:
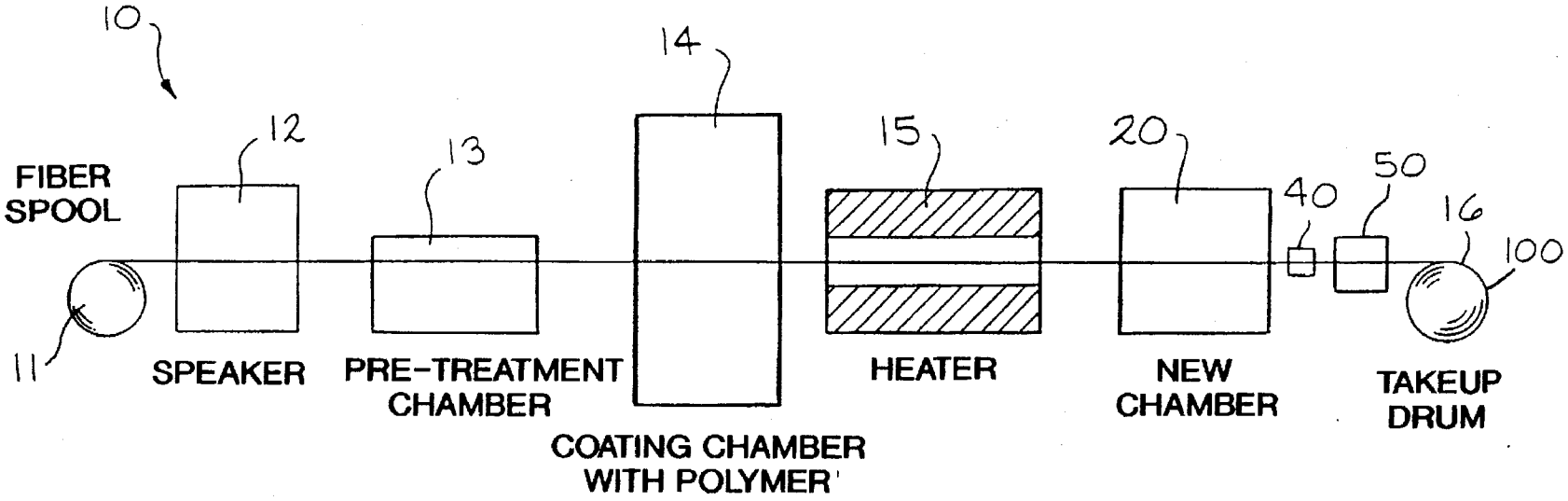

Aerosolized fine metal powders in a controlled atmosphere was used. One system 10 is shown in FIG. 1. In one method, the fibers are coated with sticky polymer in aerosolization apparatus 14, enter the oven chamber 15 for adhering the polymer to the fibers and then enter a second coating apparatus 20 where they are then coated with fine metal powders (matrix material). This coated prepreg is the precursor of the CFMMC. The precursor is then cut into pieces and laid up for hot pressing into the CFMMC.

The method of the present invention has many advantages compared with the existing CFMMC fabrication techniques:

1) it minimizes undesired interface reactions because the polymer coated precursor is produced at much lower temperatures;

2) fibers are evenly distributed throughout the composite by the spreading operation. This reduces fiber damage usually caused by fiber-to-fiber contact;

3) uniform distribution of the matrix around each fiber is achieved from the use of the aerosolizer and fine metal powder with smaller size (5.5 microns in diameter) than the diameter of the fibers (8.0 microns) as in Examples 1 and 2;

4) high fiber volume fraction can be obtained due to the effective use of the spreader and fine metal powders;

5) high quality composites can be made because of homogeneous fibers and matrix distribution, high fiber volume fraction, reduced interface reactions; and 6) it is far less expensive than most of the existing CFMMC fabrication techniques because of its simplicity, continuity and provision for automation.

The following are illustrative examples. Example 1 uses a polymer coating on the fibers. Example 2 does not use the polymer coating.

EXAMPLE 1

Figure 2A:
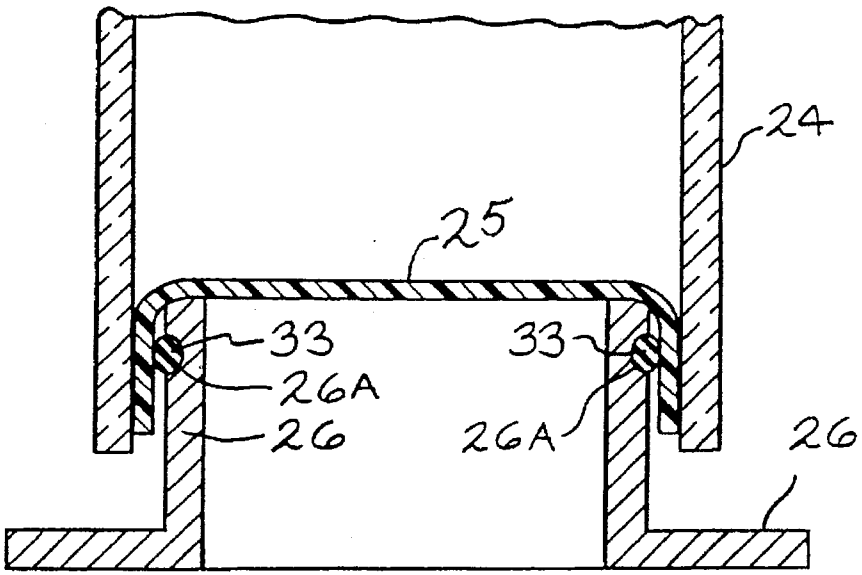
Figure 2:
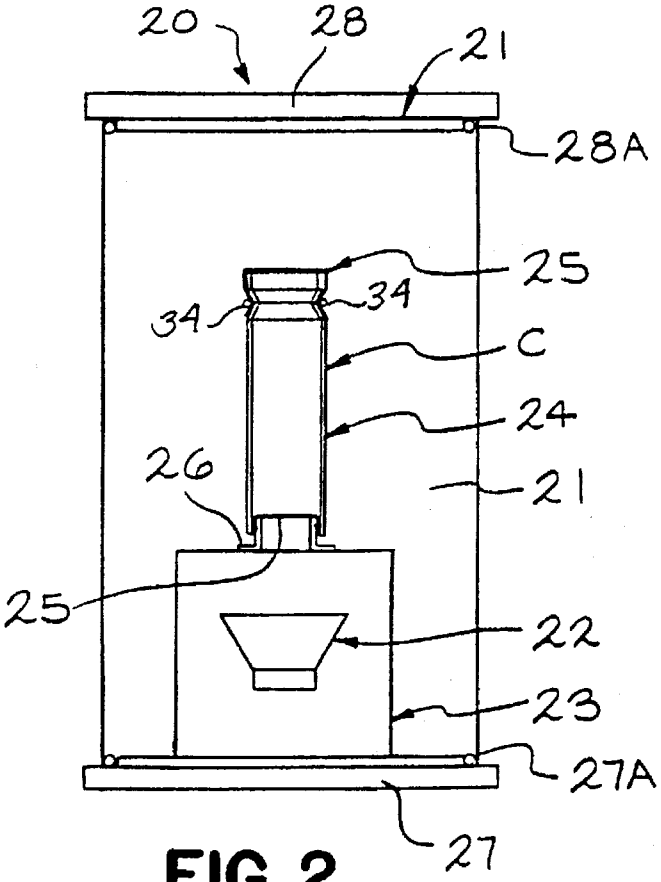

As shown in FIGS. 2 and 2A, the outer tube 21 of apparatus 20 was made of plexi-glas material because the fluidization of the powders requires visual adjustments to determine the appropriate frequency of the speaker 22. The speaker 22 was mounted in a wood box 23. A glass tube 24, was provided with membranes 25 at either end. An aluminum flange 26 at a lower end of tube 24 was connected to the speaker 22 and supports lower membrane 25 on the glass tube 24.

Figure 3B:
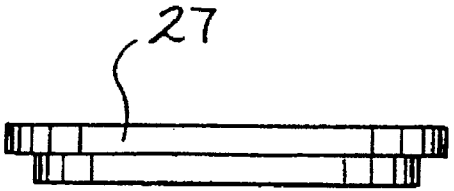
Figure 3C:
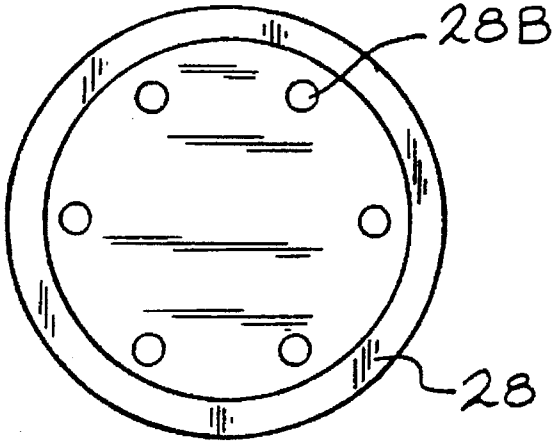
Figure 3A:
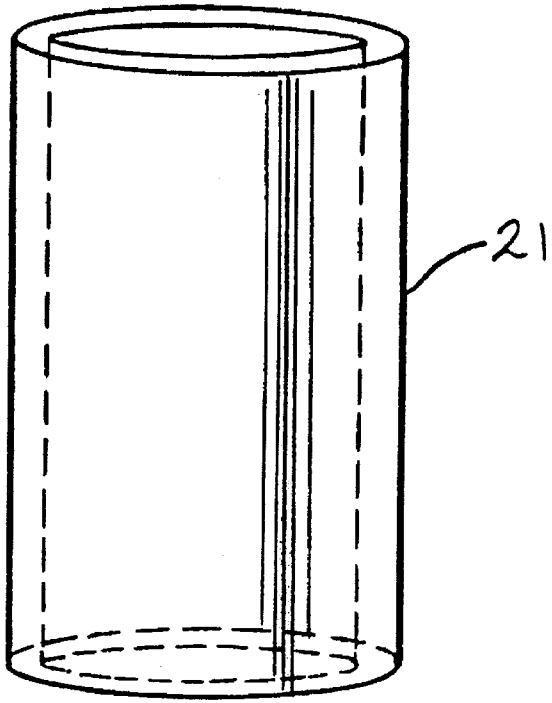

As shown in FIGS. 3A, 3B and 3C, the outer tube 21 had two lids opposed 27 and 28 made of aluminum for the top and the bottom (FIG. 3). The lids 27 and 28 each had an o-ring 27A and 28A (FIG. 2) around the inside to assure sealing. The calculations show that the outer tube 2-1 and the lids 27 and 28 were strong enough to withstand an external pressure of one atmosphere. During experiments, the two lids 27 and 28 were held onto the chamber 21 by three elastic stretch cords between them (not shown) for safety. The stretch cords will give in the event of an explosion.

Figure 4:
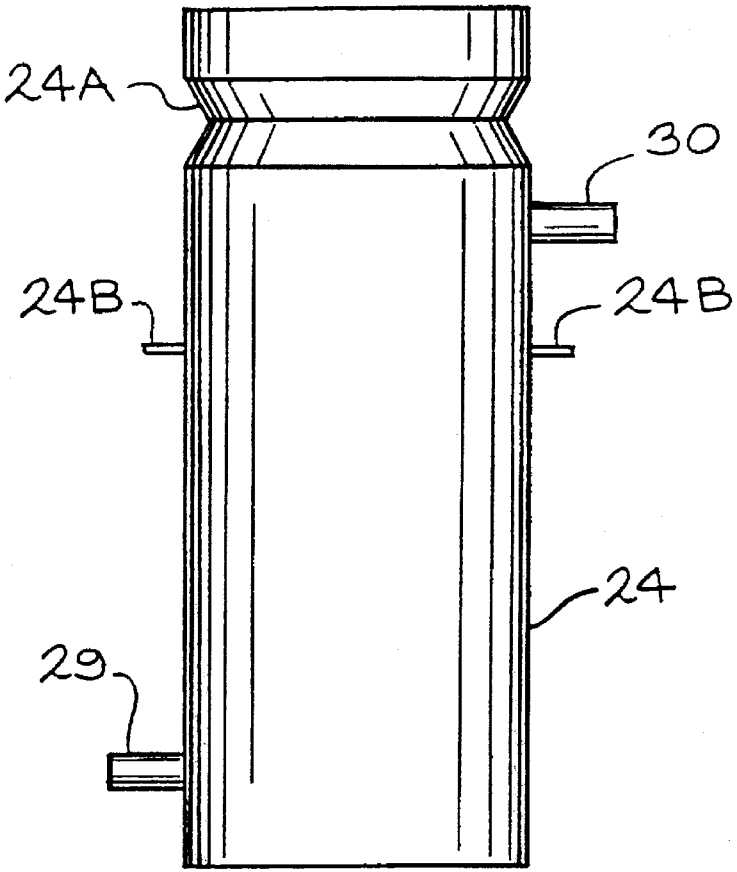

As shown in detail in FIG. 4, the inside tube 24 was a hollow where the actual coating occurs. Half an inch from the top of tube 24, a small indentation or groove 24A was provided on the outside for an o-ring 34 to hold the top membrane 25. At three inches from the top, six tungsten pins 24B were mounted around the circumference to serve as electrical feedthroughs. Two gas ports 29 and 30 were provided on the inside tube 24 open to the outer tube 21. The inside tube 24 was set on the aluminum flange 26 which was fixed by the wood box 23 above the speaker 22. The lower membrane 25 was held between the glass tube 24 and the aluminum flange 26 by a ring seal 33 in groove 26A of flange 26.

Figure 5:
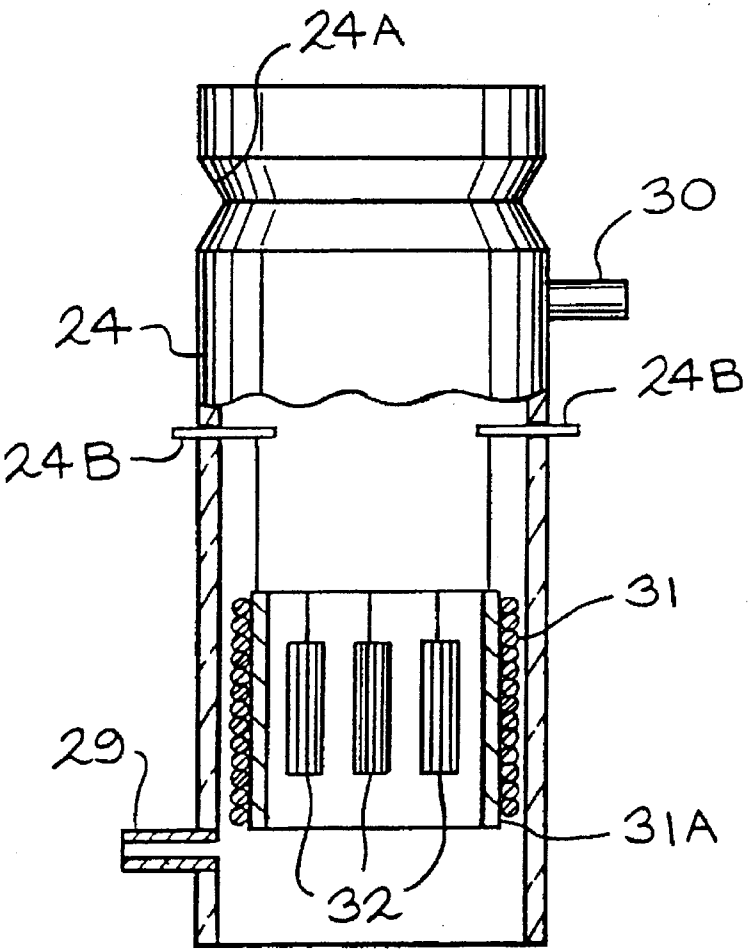

As shown in FIG. 5, a flexible heater 31 was wound around a metal tube 31A, is hung on two of the tungsten pins 24B in the inside tube 24. Prepreg tapes 32 were fixed by spring clips (not shown) inside the metal tube 31A where the temperature was almost uniform.

Tables 1 and 2 show the distribution of the temperature inside the metal tube 31A. Pins 24B were needed to pass a signal from the outside to the inside of the tube 21 without interfering with the vacuum level inside the tube 21. The feedthroughs 72 to 75 (FIG. 6) were made of bulkhead unions that fit through the holes 28A of the top lid 28.

TABLE 1

The distribution of the temperature inside the metal tube 31A.

| Time (min.) | Temperature at Bottom (°C.) | Temperature at middle (°C.) | Temperature at top (°C.) |
|---|---|---|---|
| 5 | 165 | 156 | 167 |
| 6 | 177 | 168 | 176 |
| 7 | 181 | 178 | 186 |
| 8 | 189 | 186 | 192 |
| 9 | 197 | 192 | 197 |
| 10 | 198 | 198 | 201 |

TABLE 2

The temperature as a function of heating time inside metal tube 24

| Time (min.) | Temperature at middle (°C.) |
|---|---|
| 0 | 27 |
| 1 | 78 |
| 2 | 120 |
| 3 | 140 |
| 4 | 156 |
| 5 | 160 |
| 6 | 172 |
| 7 | 183 |
| 8 | 187 |
| 9 | 191 |
| 10 | 197 |

The speaker 22 was mounted inside the wood box 23 which had a circular opening (not shown) on top to allow the upward propagation of the sound waves to inside tube 24. The wood box 23 was painted with epoxy glue to avoid the release of volatile compounds that could interfere with the vacuum level. The box 23 was connected to the inside tube 24 through aluminum flange 26 whose circular base covered the opening of the wood box 23. The aluminum flange 26 also had an outside indentation 26A for an o-ring to hold the lower rubber membrane 25 where the inside tube 24 is fitted. The speaker 22 was controlled by a frequency generator and a power amplifier located near the experimental apparatus 20 (not shown).

Figure 6:
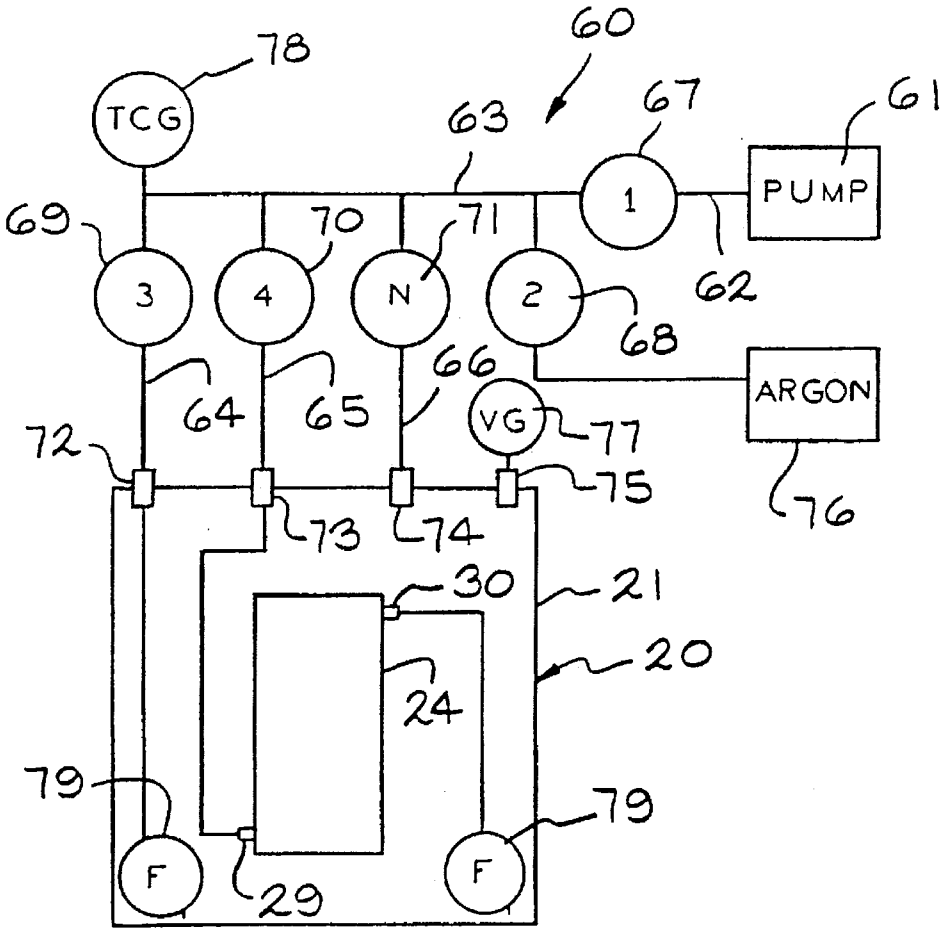
Figure 8A:
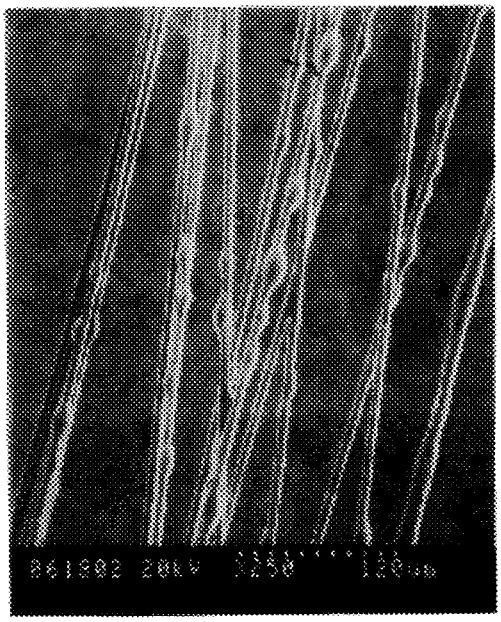
FIGS. 8A is a scanning electron microscope (SEM) micrograph of an Example 1 type A prepreg (250X) and FIG. 8B is a SEM micrograph of a type B prepreg (300x) prior to incorporating the metal matrix.
Figure 8B:
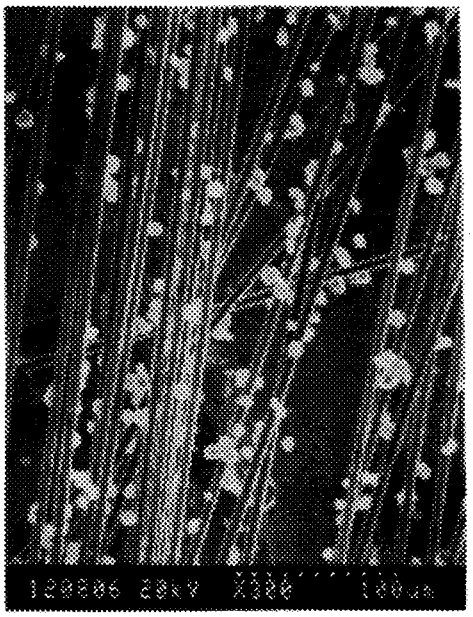
Figure 9A:
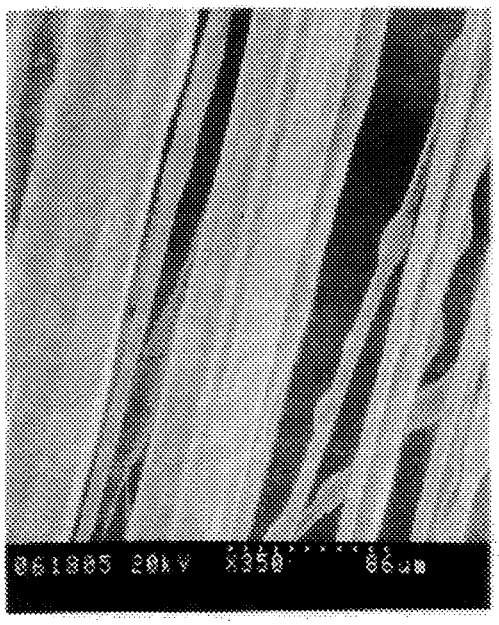
FIG. 9A is another SEM micrograph of the type A prepreg (350X) and FIG. 9B is another SEM micrograph of the type B prepreg (800X).
Figure 9B:
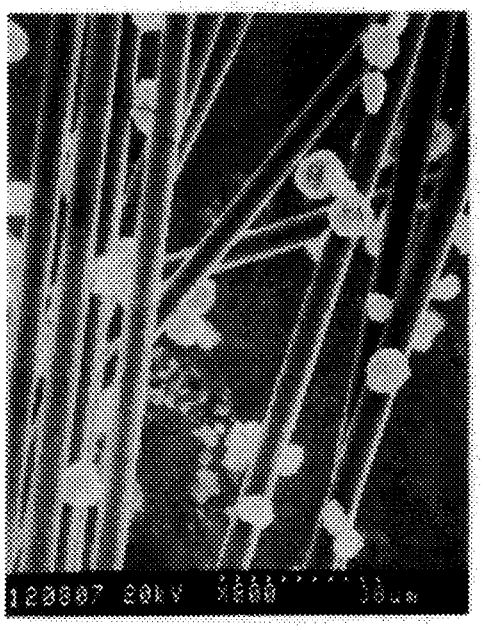
Figure 10A:
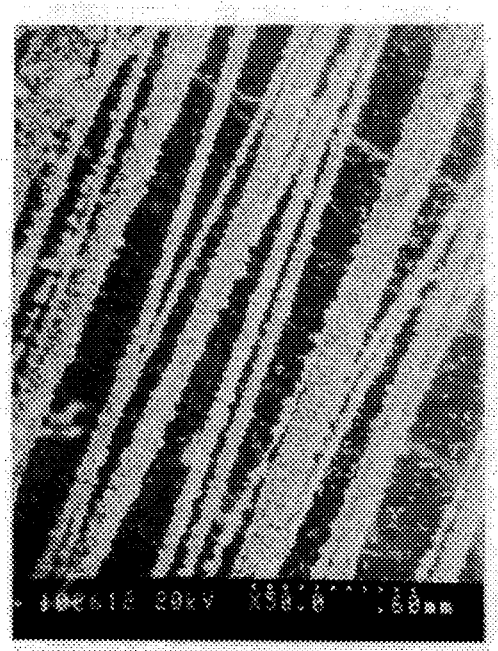
FIG. 10A is the SEM micrograph of the type A prepreg (50X) coated with aluminum powders.
Figure 10B:
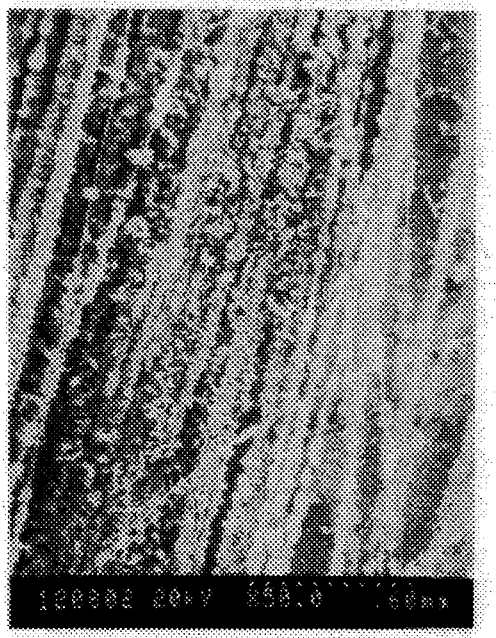
FIG. 10B is the SEM micrograph of the type B prepreg coated with aluminum particles (50X).
Figure 11A:
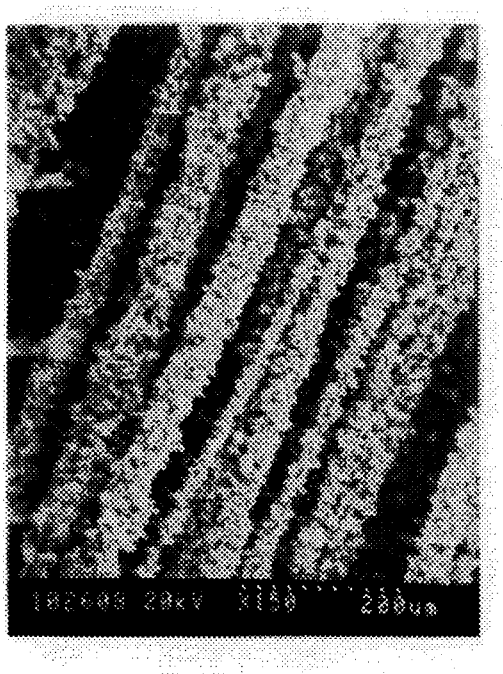
FIG. 11A is another SEM micrograph of the type A prepreg coated with the aluminum particles (150X) and FIG. 11B is another SEM micrograph of the type B prepreg coated with the aluminum powder (250X).
Figure 11B:
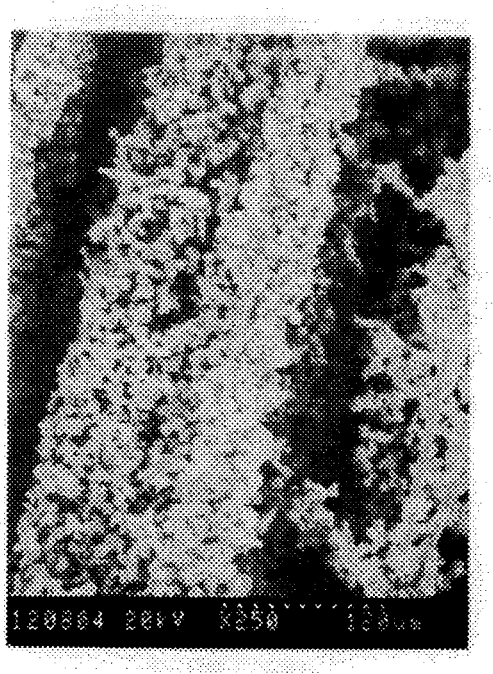

As shown in FIG. 6, the vacuum system 60 included a vacuum pump 61 connected to the inside tube 24 by thick wall flexible vacuum hoses 62, 63, 64, 65 and 66. Ball valves 67, 68, 69, 70 and 71 were used to control the gas flow in and out of the inside tube 24. Vacuum feedthroughs 72, 73, 74 and 75 were sealed in a similar way to the pins 27. A supply 76 of gas (argon) was provided along with a vacuum gauge 77 and a pressure gauge 78. Filters 79 were provided for vacuum lines 64 and 75.

Safe handling of aluminum powder is essential because of the potential risk of an explosion. Aluminum reacts instantaneously with oxygen to form a thick film of aluminum oxide on the surface of the aluminum when exposed to the atmosphere. The oxide layer is stable in air and prevents further oxidation of underlying aluminum. However, if fine aluminum powder, usually less than 44 microns (325 mesh), is suspended in air and heated to reach the ignition point, the burning extends from one particle to another with such rapidity (rate of pressure rise in excess of 20,000 PSi/Sec) that a violent explosion results (Aluminum Association Handout, "Recommendation for Storage and Handling of Aluminum Powders and Paste", TR-2). It has been reported that the proportion of aluminum powder required for an explosion is very small (45 g/m$^3$). Aluminum dust will ignite with as little as 9% oxygen present (the balance being nitrogen; or 10% oxygen with the balance helium; or 3% oxygen with the remainder carbon dioxide. Very small amounts of energy are required to ignite certain mixtures of aluminum powder and air. In some case energy as low as 25 millijoules can cause ignition.

Some basic safety rules of handling aluminum powder which are recommended by the Aluminum Association are:

Rule 1: Avoid any condition that will suspend or float powder particles in the air creating a dust cloud. The less dust suspended in the air, the better.

1) Keep all containers closed and sealed. When a drum of aluminum powder is opened for loading or inspection, it should be closed and resealed as quickly as possible.

2) In transferring aluminum powder, dust clouds should be kept at an absolute minimum. Powder should be transferred from one container to another using a non-sparking, conductive metal scoop with as little agitation as possible. Handling should be slow and deliberate to hold dusting to a minimum. Both containers should be bonded together and provided with a grounding strap.

3) In mixing aluminum powder with other dry ingredients, frictional heat should be avoided. The best type of mixer for a dry mixing operation is one that contains no moving parts, but rather affects a tumbling action, such as a conical blender. Introduction of an inert atmosphere in the blender is highly recommended since dust clouds are generated. All equipment must be well-grounded.

Rule 2: When possible, avoid actions that generate static electricity, create a spark or otherwise result in reaching the ignition energy or temperature.

1) Locate electric motors and as much electrical equipment as possible outside processing rooms. Only lighting and control circuits should be in operating rooms. All electrical equipment must meet National Electrical Codes for hazardous installations. This includes flash lights, hazardous portable power tools, and other devices.

2) Use only conductive material for handling or containing aluminum powders.

3) No smoking, open flames, fire, or sparks should be allowed at operation and storage areas or dusty areas.

4) No matches, lighters, or any spark-producing equipment can be carried by an employee.

5) During transfer, powder should not be poured or slid on non-conductive surfaces. Such actions build up static electricity.

6) powder should always be handled gently and never allowed to fall any distance because all movement of powder over powder tends to build up static charges.

7) Work clothing should be made of smooth, hard-finished, closely woven fire resistant/fire retardant fabrics which tend not to accumulate static electric charges. Trousers should have no cuffs where dust might accumulate.

8) Bonding and grounding machinery to remove static electricity produced in powder operations are vital for safety.

9) All movable equipment, such as drums, containers, and scoops, must be bonded and grounded during powder transfer by use of clips and flexible ground leads.

Rule 3: Consider the use of an inert gas which can be valuable in minimizing the hazard of handling powder in air.

However, in the three general rules, Rule 3 is the most important safety precaution method for the process of aluminum powder coating on fibers, which is the key step in the fabrication of CFMMC, because the coating operation is preferably performed in aluminum cloud at 170° C. By pumping a vacuum and introducing argon repeatedly, oxygen can be reduced to the safe volume fraction.

The amount of oxygen left inside the inside tube 24 can be determined by the ideal gas law:

$$PV=nRT \tag{5-1}$$

First, assume that after pulling a vacuum on the tube 24 of volume V at temperature T to decrease the pressure from one atmosphere to a pressure $P_o$, only $n_o$ moles of $O_2$ and $4n_o$ of $N_2$ are left in the tube 24. Applying the equation (5-1) gives:

$$5n_o=P_o\ (V/RT) \tag{5-2}$$

Second, assume that $n_1$ moles of Ar are introduced to the tube 24 to go back to atmospheric pressure. The total number of gas moles n is given by $n=5n_o+n_1$. Applying the equation (5-1) again to get:

$$5n_o+n_1=(1\ atm)\ (V/RT) \tag{5-3}$$

Combining equation (5-2) and (5-3), and rearranging it gives the $Ar/O_2$ ratio as:

$$n_1/n_o=5((1/P_o)-1) \tag{5-4}$$

Table 3 gives the $Ar/O_2$ ratio and oxygen volume percentage for different vacuum levels.

TABLE 3

Oxygen volume percentage as a function of different vacuum levels.

| Vacuum level (torr) | $Ar/O_2$ ratio | Number of $O_2$ moles | Oxygen volume percentage |
|---|---|---|---|
| 76.3* | 49 | $28.02 \times 10^{-3}$ | 2.0% |
| 36.5 | 99 | $14.55 \times 10^{-3}$ | 0.96% |
| 24.0 | 150 | $9.76 \times 10^{-3}$ | 0.65% |
| 11.5 | 328 | $4.54 \times 10^{-3}$ | 0.30% |
| 0.76 | 4995 | $0.30 \times 10^{-3}$ | 0.02% |

*If pump twice to reach the vacuum level 76.3 torr again, then:
$Ar/O_2$ ratio: 499
Number of $O_2$ moles: $3.03 \times 10^{-3}$
Oxygen volume percentage: 0.20%

As a conclusion, the oxygen amount present can be controlled by the vacuum level reached in the tube 24 before introducing argon to prevent the explosion of aluminum powder. On the positive side, argon adsorption to surface of aluminum powder is beneficial for a limited time following re-entry to air.

In addition, worker protection must be used for handling aluminum powder. Goggles and mask are strongly recommended.

The matrix material used in this experiment is pure aluminum metallic powder (atomized) manufactured by Valimet Inc. (Stockton, Calif.). The powder had a spherical shape with an average of 5.5 microns in diameter. The reinforced fiber was a continuous high-strength, PAN-based carbon fiber manufactured by Hercules Inc. (Magna, Utah). The filament had a size of 8 microns in diameter with round shape. There were 3000 filaments per tow which had 3587 MPa in terms of tensile strength. The reinforced components used directly were prepreg tapes of nylon-coated carbon fibers produced by the powder prepregging system at the Composite Materials and Structures Center, East Lansing, Michigan (CMSC), rather than the loose tow fibers. Type A prepreg was the regular product of CMSC for the production polymer matrix composites, which was processed at 170° C. to meet the polymer coating. Type B prepreg was a special product for the production of C/Al composite using the method of the present invention, which was processed at 165° C. to meet the polymer coating. The processing temperature of the polymer coated fiber prepreg would range from 150° C. to 250° C. depending on the polymer selected. The properties of the type A and type B prepregs are shown in Table 4.

TABLE 4

Properties of materials used in the experiment

| Material/Property | Value |
|---|---|
| Hercules AS-4 Carbon Fibers | |
| Diameter (microns) | 8.0 |
| Specific gravity (g/cm³) | 1.80 |
| Tensile strength (MPa) | 3.587 |
| Tensile modulus (GPa) | 235 |
| Polyamide | |
| Average particle size (μm) | 10.0 |
| Specific gravity (g/cm³) | 1.02 |
| Melting point (°C.) | 175 |
| Surface tension (mJ/m²) | 30.0 |

TABLE 4-continued

Properties of materials used in the experiment

| Material/Property | Value |
|---|---|
| Aluminum Powders | |
| Average particle size (μm) | 5.5 |
| Density (g/cm³) | 2.69 |
| Apparent density (g/cm³) | 0.6 |
| Chemical composition: | |
| Aluminum | 99.7% |
| Iron | 0.18% |
| Silicon | 0.2% |
| Type A Prepregs | |
| Processing temperature (°C.) | 170 |
| Type B Prepregs | |
| Processing temperature (°C.) | 165 |

The procedures involved in production of aluminum powder coated prepreg precursors were 1) The polymer prepreg tapes were cut into 5 cm pieces.

2) The prepreg tapes were fixed inside the metal tube 31A with spring clips as shown in FIG. 5.

3) The metal tube 31A was hung on the pins 4B inside the glass tube.

4) 3–5 g of aluminum powder was deposited on the bottom membrane 25.

5) The inside tube 24 was fitted on the top of the aluminum flange 26.

6) The top membrane 25 was placed in position with the help of the o-ring.

7) All of the electric wires and vacuum hoses were connected properly.

8) The aluminum lid 28 was placed on the outer tube 21.

b 9) The vacuum pump 61 was operated until the pressure inside the tube 24 was reduced to below 3 in Hg.

10) Argon was introduced slowly to one atmosphere (14.7 psig).

11) Steps 9 and 10 were repeated.

12) The heater 31 was turned on and heated for 6 minutes for type A prepreg 32 and 3 minutes for type B prepreg 32.

13) The frequency generator or speaker 22 and the power amplifier was turned on to fluidize the aluminum powder for 3 minutes for type A prepreg 32 and minutes for type B prepreg 32.

14) The heater 31 was turned off after heating 8 minutes.

15) The prepreg 32 was removed in reverse order of steps 1–8 after the powder settled down and the temperature cooled down.

The aluminum-coated carbon fiber precursors then were consolidated by vacuum hot pressing in a conventional vacuum furnace such as furnace 40 using a MTS-810 Material Test System (Minneapolis, Minn.). The procedures and processing parameters used were:

1) Align dozens of prepreg 32 layers in mats.

2) Cut the aligned prepreg 32 into 2 cm long and 1 cm wide.

3) Wrap the aligned and trimmed prepreg with two pieces of aluminum foils in transverse direction.

4) Put a layer of boron nitride paste evenly on the outside of the aluminum foils.

5) Place the wrapped and pasted precursors between two pieces of thin alumina plates.

6) Place the sample in the fixture.

7) Put the fixture on the bottom platen inside the pressing furnace.

8) Press the top platen on the sample with pressure of a little more than zero.

9) Close the furnace and pump vacuum to less than $2\times10^{-5}$ Torr.

10) Ramp the temperature to 420° C. in 15 minutes.

11) Keep the temperature at 420° C. for one hour to evaporate the binder material (nylon).

12) Increase the temperature to 570° C. in 5 minutes.

13) Keep the temperature at 570° C. for 5 minutes.

14) Press the sample under 30 MPa at 570° C. for 30 minutes.

15) Release the pressure and decrease the temperature to 400° C. in 5 minutes.

16) Cool the sample naturally to room temperature.

17) Extract the CFMMC after the furnace cooled.

Figure 7:
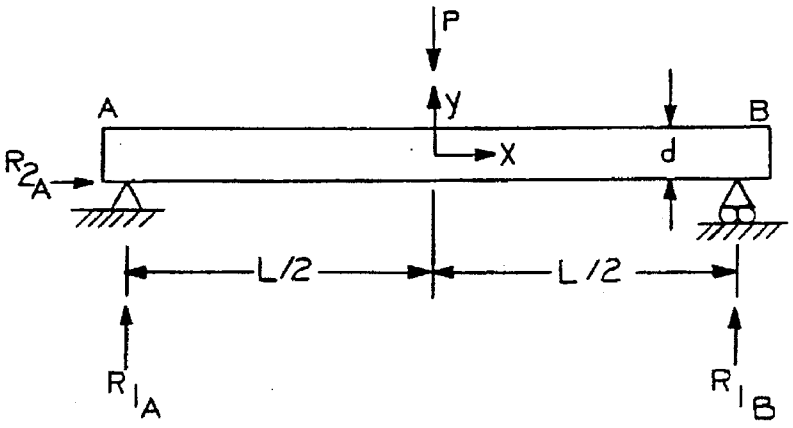

The mechanical properties of the composite were measured using United Testing System SFM-20. A three-point bending test was performed. The original composite was approximately a 1 mmthick×12 mm wide×21 mm long plate for the sample which was made from type A prepreg, and a 2 mm thick×12 mm wide×21 mm long plate for the sample which was made from the B prepreg. The plates were cut into 1.65 mm wide specimens by a low speed diamond saw after the composite plate was trimmed to eliminate unconsolidated materials at the edges, and cleaned to remove the stop-off materials. Referring to FIG. 7, the flexural strength and modulus of the composite was evaluated by following equations:

$$S_{Fc}=3PL/2bd^2 \quad (5\text{-}5)$$

$$E_{Fc}=PL^3/4\delta bd^3 \quad (5\text{-}6)$$

Where $S_{Fc}$=the flexural strength of the composite

P=the loading

L=the span b=width of the specimen d=thickness of the specimen $E_{Fc}$=the flexural modulus of the composite δ=deflection increment at midspan The flexural strength of the composite from the three point bending test can be compared with the theoretical value calculated from equations (3-3) and (5-7) (Weeten, J. W., et al., Engineers' Guide to Composite Materials, Carnes Publication Services, USA (1987)) which is derived from the rule of mixtures and the contribution of the matrix is neglected.

$$S_{Fc}=3V_fS_{Tf}/(1+S_{Tf}/S_{Cf}) \quad (5\text{-}7)$$

wherein $S_{Fc}$=the flexural strength of the composite

STf=the tensile strength of the fiber $S_{Cf}$=the compression strength of the fiber $V_f$=the fiber volume fraction If $S_{Cf}$ is not known, $S_{Cf}=0.9\ S_{Tf}$ is a good approximation for graphite fiber/matrix composites.

The broken specimens from the mechanical test then were mounted, polished and examined by Olympus PME 3 Metallograph. The fracture surfaces of the specimens were examined using Hitachi S-2500C scanning Electron Microscope (SEM) (Japan).

The fiber volume fraction was determined by counting the fibers observed on a composite cross-section and using the relation:

$$V_f=(N\times A_f)/A_t$$

Where $V_f$=the fiber volume fraction

N=the number of fibers $A_f$=the average cross-sectional area of a single fiber $A_t$=the total cross-sectional area This work was done by Optical Numeric Volume Fraction Analysis Software (Michigan State University, East Lansing, Mich.).

FIGS. 8A and 8B and 9A and 9B show scanning electron microscope (SEM) images of type A prepreg and type B prepreg 32 at different magnifications. The prepregs, which were produced by the Composite Materials and Structures Center at Michigan State University, were used to make the CFMMC. For type A prepreg 32, it is apparent from these micrographs that there is satisfactory coating with nylon on the carbon fibers in the prepreg although there are some droplets formed on the fibers. The fibers were almost spread uniformly while some fibers contacted together and some fibers crossed. For type B prepreg 32, the nylon particles just begin sintering or even sintering had not occurred. So some nylon particles were lost during handling and the fibers were not held together by nylon to form tape.

FIGS. 10A and 10B and 11A and 11B show two types of SEM images of C/Al composite precursors at different magnifications. The precursor has a satisfactory aluminum powder pick-up. The successes include: 1) the amount of aluminum powder is large enough; 2) the adhesion between the fiber and the powder is strong enough to survive handling; 3) the distribution of the aluminum powder is uniform for type A precursors. For type B precursors, fiber coating is uneven because of the existence of some uncoated fibers. The disadvantage is that the fiber contacting and crossing can still be found, which is due to the fabrication of nylon coated fiber prepregs.

Figure 12:
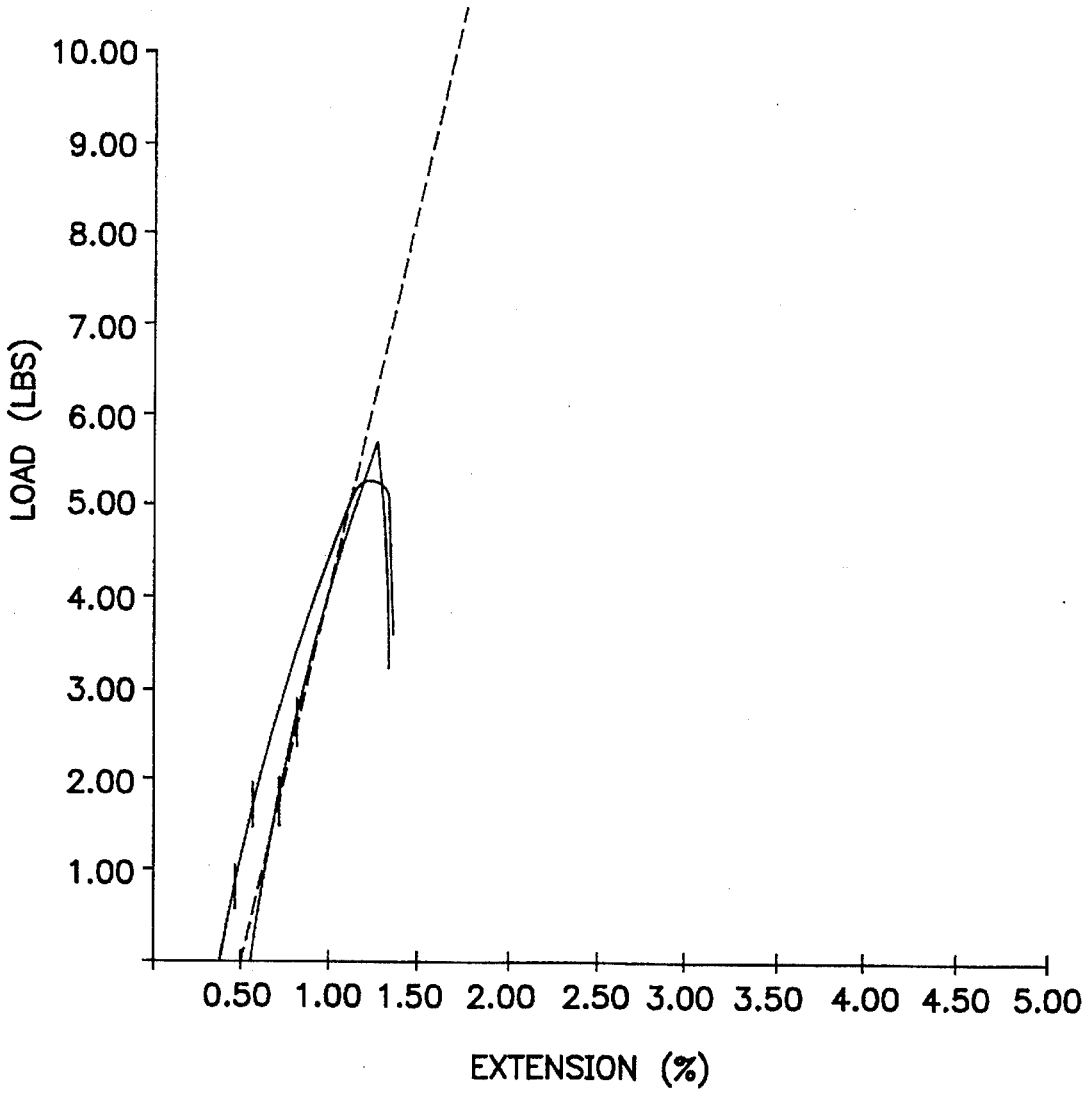
FIG. 12 is a graph showing a load-extension curve for the CFMMC from two samples of the type A prepreg consolidated with the aluminum powder to form the CFMMC.
Figure 13:
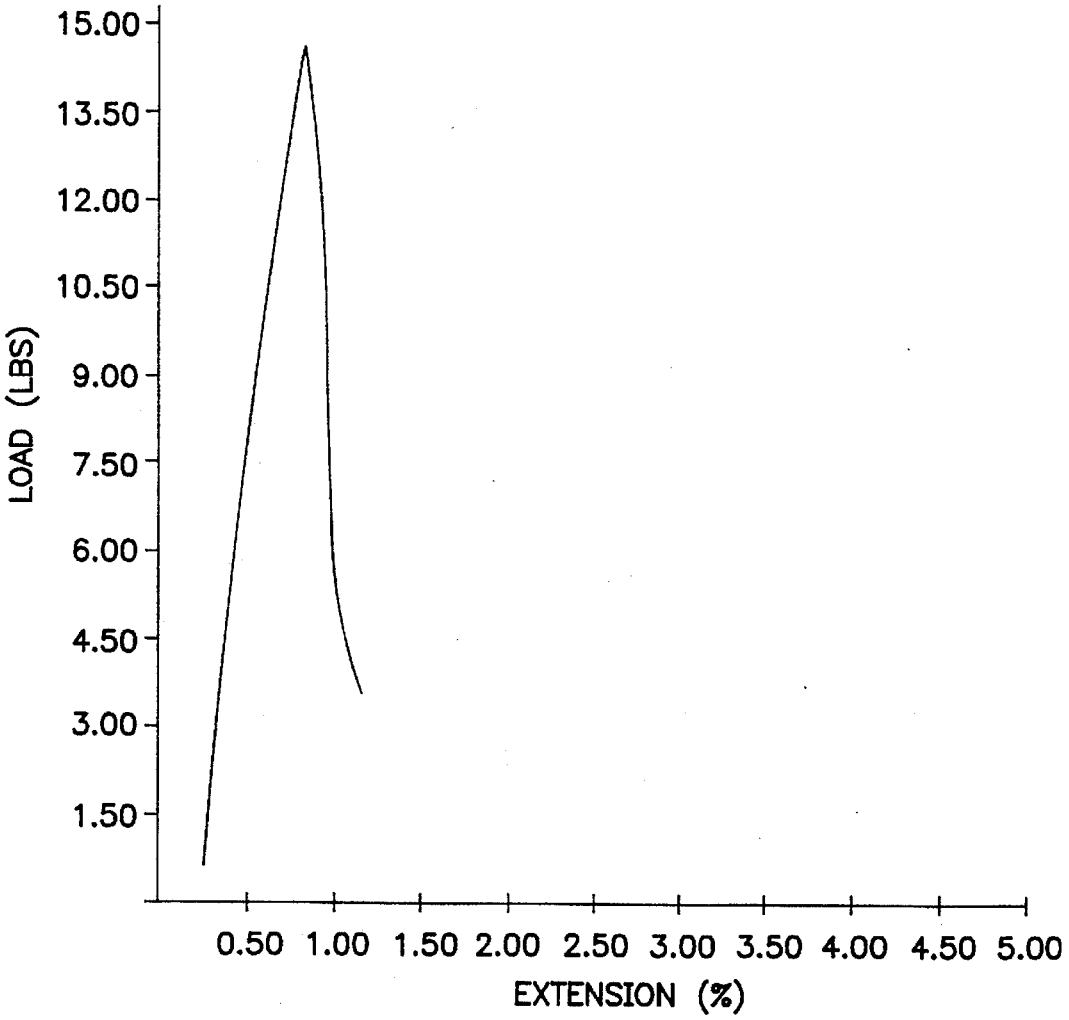
FIG. 13 is a graph showing a load-extension curve for the CFMMC from a sample of the type B prepreg consolidated with the aluminum powder.
Figure 14A:
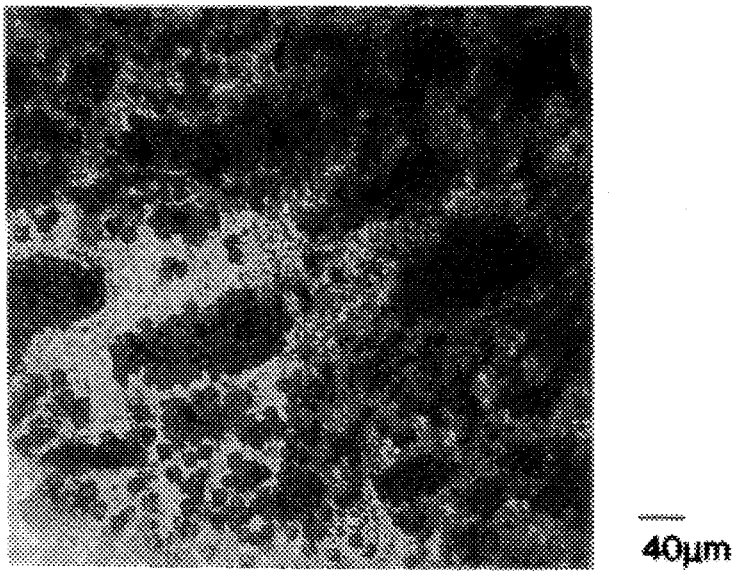
FIG. 14A is a typical SEM micrograph of a cross-section of the CFMMC from the type A prepreg (200X).
Figure 14B:
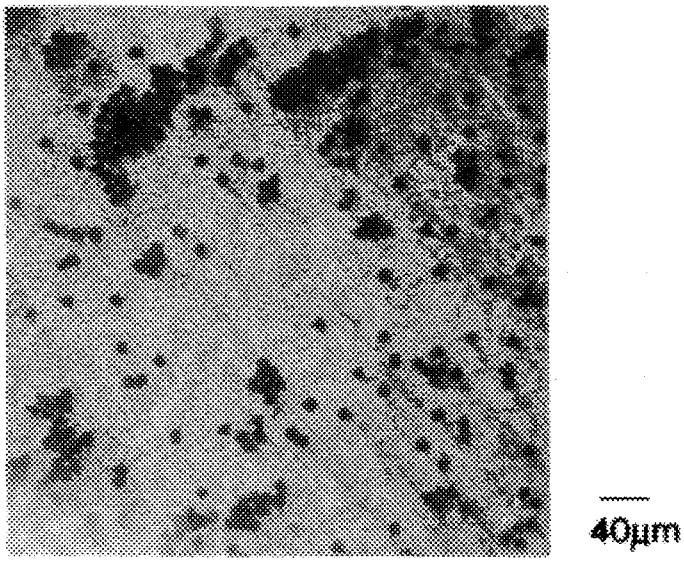
FIG. 14B is the SEM micrograph from the type B prepreg (200X).
Figure 15A:
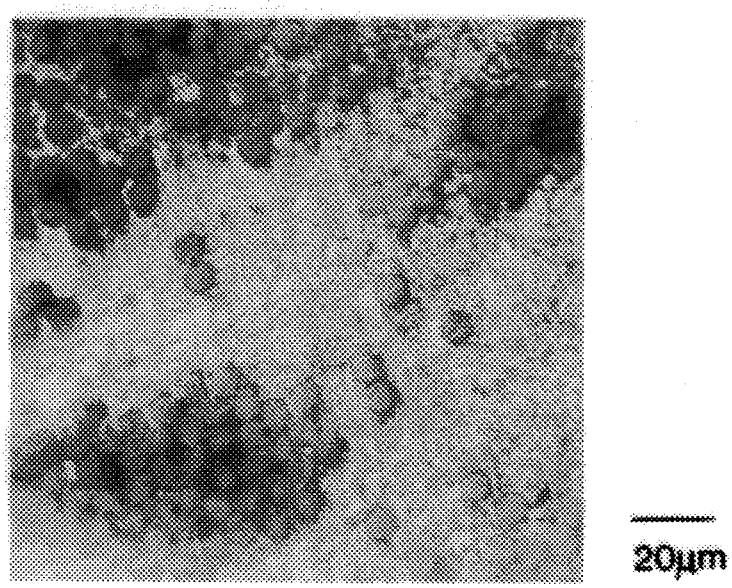
FIG. 15A is another SEM micrograph of the CFMMC from the type A precursor (500X).
Figure 15B:
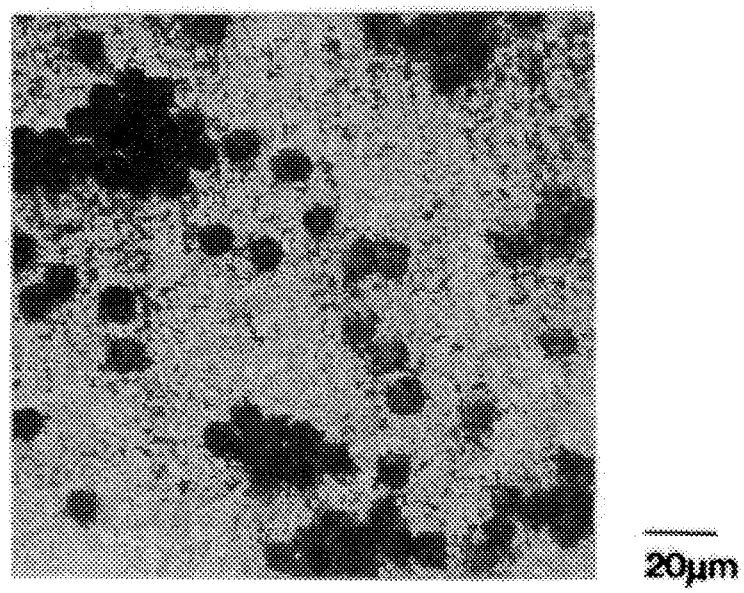
FIG. 15B is the SEM micrograph from the CFMMC of the type B prepreg.
Figure 16A:
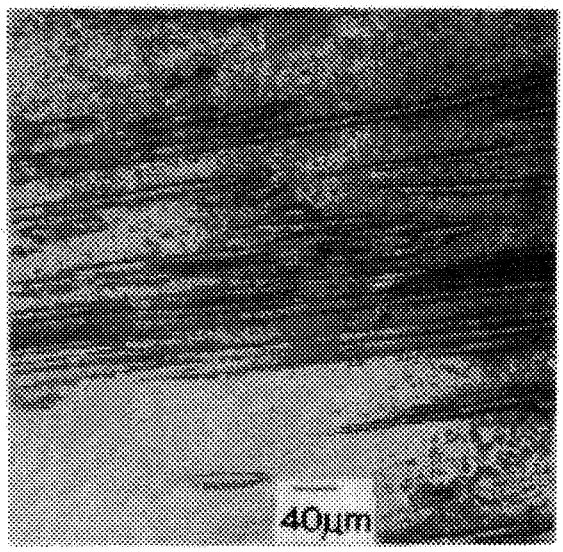
FIG. 16A is an optical micrograph from a longitudinal section of the CFMMC from the type A prepreg (200X).
Figure 16B:
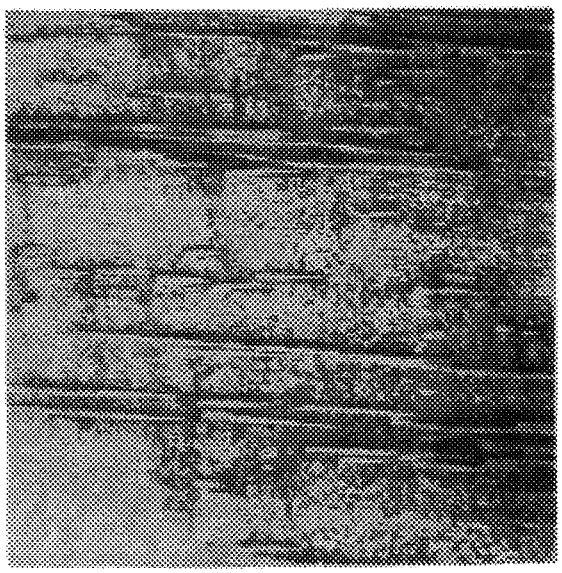
FIG. 16B is the optical micrograph of a longitudinal section of the CFMMC from the type B prepreg (200X).
Figure 17A:
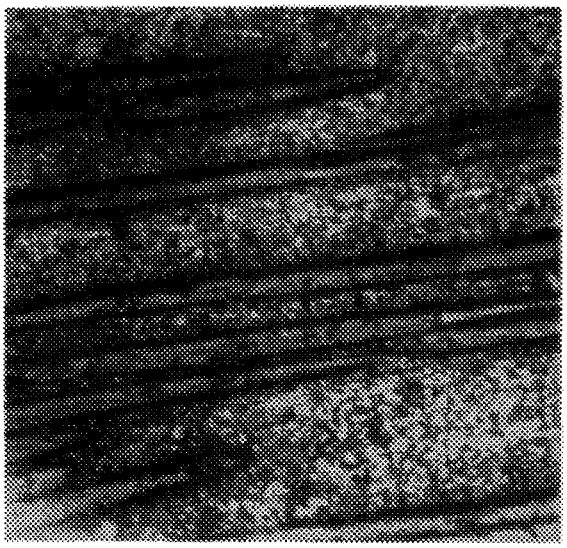
FIG. 17A is another optical micrograph of a longitudinal section of the CFMMC from the type A prepreg (500X).
Figure 17B:
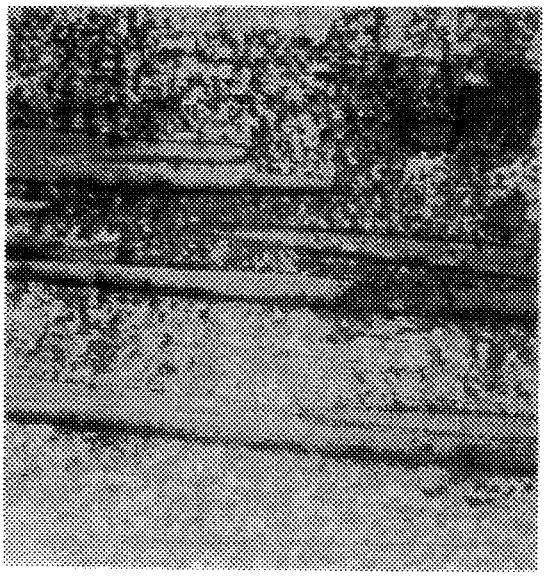
FIG. 17B is the optical micrograph of the longitudinal section of the CFMMC from the type B prepreg (500X).
Figure 18A:
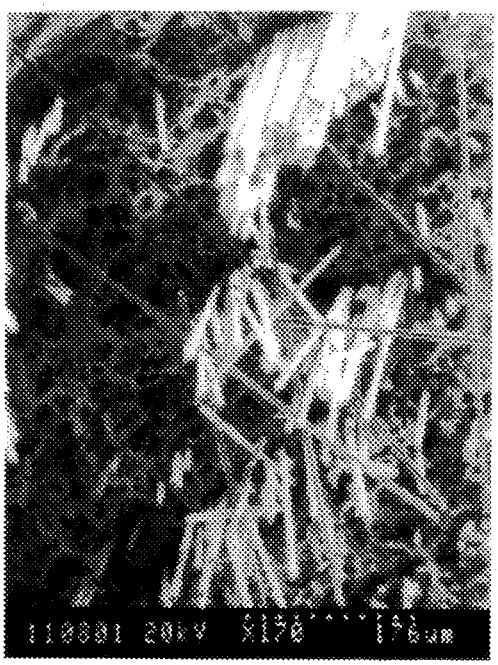
FIG. 18A is SEM fractograph (pulled apart) of the CFMMC from the type A prepreg (170X).
Figure 18B:
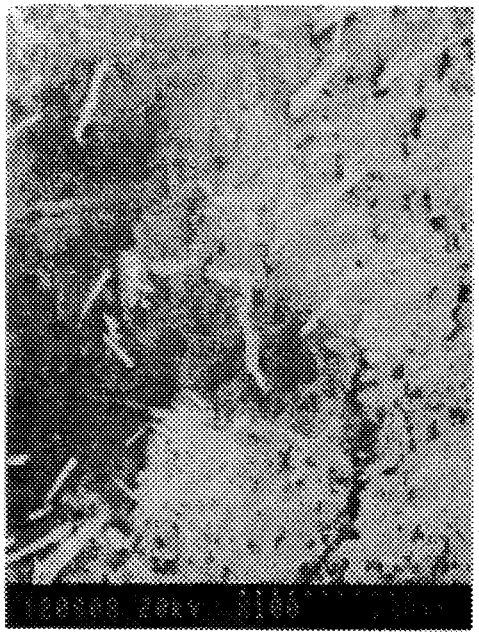
FIG. 18B is the fractograph from the CFMMC from the type B prepreg (100X).
Figure 19A:
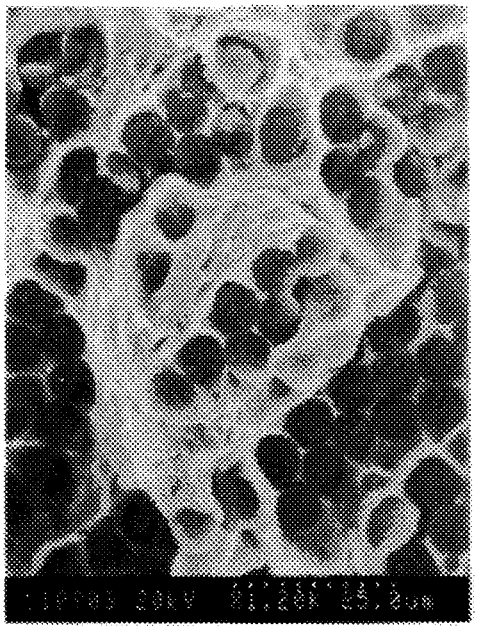
FIG. 19A is another SEM fractograph of the CFMMC from the Type A prepreg (1.20kx).
Figure 19B:
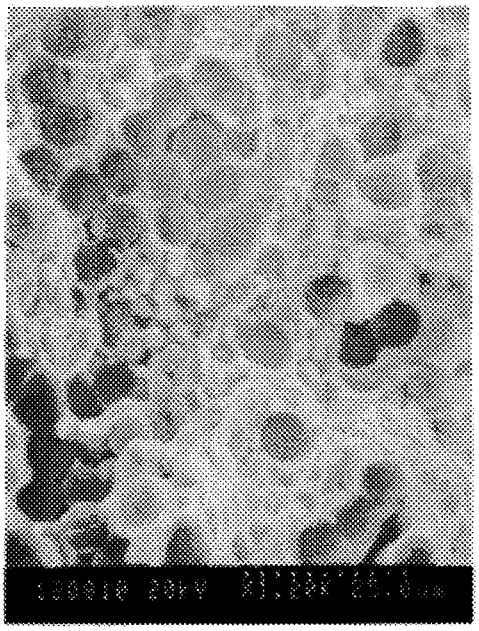
FIG. 19B is the SEM fractograph of the CFMMC from the Type B prepreg (1.20 kx).

The results of the mechanical test for the continuous high strength carbon fiber reinforced aluminum matrix composite materials are shown in Table 5 and FIGS. 12 and 13. The flexural strength of the composite is 335 MPa for sample A (343 MPa for sample Al and 328 MPa sample A2) and 285 MPa for sample B as compared to 82.8 MPa for the unreinforced pure aluminum matrix. The flexural modulus of the composite is 108 GPa for sample A (122 GPa for sample Al and 94 GPa for sample A2) and 74 GPa for sample B as compared to 69 GPa for the unreinforced pure aluminum matrix.

FIGS. 14A and 14B and 15A and 15B show the typical optical micrographs of the cross section of the C/Al composites, which were used to determine the fiber volume fraction. It was found that the fiber volume fraction is 50% for the sample from the type A prepreg and 20% for the sample from the type B prepreg. Using the above value of fiber volume fraction and the tensile strength and modulus value of carbon fibers and aluminum matrix from Table 5, the flexural strength of the rule of mixtures at these fiber volume fractions were calculated to be 2549 MPa for sample A and 1019 MPa for sample B. The flexural strength of the composite is 13% of the rule of mixtures for type A and 28% for type B. The modulus of the rule of mixtures at these fiber volume fractions was determined to be 151 GPa for type A and 112 GPa for sample B. The modulus of the composite is 71% of the rule of mixtures for type A and 66% for type B.

TABLE 5

Mechanical properties of Example 1 composites at room temperature

| Specimens | A1 | A2 | B1 |
|---|---|---|---|
| Span, mm (in.) | 18.0 (0.71) | 18.0 (0.71) | 18.0 (0.71) |
| Width, mm (in.) | 1.65 (0.065) | 1.65 (0.065) | 1.65 (0.065) |
| Thickness, mm (in.) | 1.07 (0.042) | 1.13 (0.0445) | 1.93 (0.076) |
| Yield load, N (lbs) | 0.08 (0.0183) | 0.54 (0.122) | 0.11 (0.0244) |
| Peak load, N (lbs) | 23.84 (5.359) | 25.61 (5.756) | 64.90 (14.587) |
| Yield STR MPa (Psi) | 1.2 (170.1) | 0.7 (101.1) | 0.5 (69.25) |
| Flexural STR MPa (Psi) | 343 (49775) | 328 (47622) | 285 (41380) |
| Fiber Fraction (%) | 50 | 50 | 20 |
| % ROM Strength | 13 | 13 | 28 |
| Flexural Modulus, GPa (Ksi) | 122 (17625) | 94 (13554) | 74 (10754) |
| % ROM Modulus | 80 | 62 | 66 |
| Strain at failure (%) | 0.6543 | 0.5548 | 1.044 |

FIGS. 16A and 16B and 17A and 17B show the optical micrographs of the longitudinal section of type A and type B. From these Figures, it is obvious that the fiber-matrix interface is smooth with no discontinuities observed even at higher magnification. This implied that the fiber-matrix bonding is good with no excessive interface reaction and no fiber damage. However, these micrographs show that some carbon fibers contact together to form the fiber clusters, especially for type A. FIGS. 18A and 18B and 19A and 19B show the SEM fractographs of type A and type B. It can be seen that the dispersed fibers were not pulled out while the clustered fibers were pulled out. The fractographs show that the aluminum powders were sintered well generally while a few of unsintered aluminum powders can be found in type B in FIG. 19B at arrow. This could be due to the fact that these powders were located in a local void where the pressure could not reach them.

The new fabrication process of composite precursors was capable of picking up the desired volume fraction of metal matrix. The distribution of fine metal powder around the reinforcing fibers was uniform. The precursor tapes with the aluminum powder were almost as flexible as the reinforcing fiber tow with good handling properties. The polymer worked well as the binder and hence no significant aluminum powder loss was found during the layup procedure prior to consolidation. This suggested that the adhesion of the aluminum powder to the carbon fibers was strong. For type A prepreg 32, the formation of the fiber clusters played two roles. First, the aluminum precursors were easy to handle during the layup procedure because the fibers do not move relative to one another. Secondly, it made the fibers distribute unevenly.

There are four key factors which resulted in the success of composite precursor production.

1) The spreader 12 which worked on the principle of acoustic energy was able to spread collimated fiber tows into their individual filaments. It worked best at the natural frequency of the reinforcing fibers.

2) The apparatus 20 which utilized acoustics to provide a buoyant force to the powder was a stable entrainment system which provided an aerosol of constant aluminum powder concentration for extended periods of time. It operated best at its natural frequency.

3) The use of fine metal powder roughly of the order of dimensions of the reinforcing fibers made the distribution of the matrix around each fiber uniform.

4) Polyamide polymer worked very well as a binder to adhere the aluminum powder on the carbon fibers at proper temperature.

However, the presence of fiber clusters in the prepreg 32 was a remaining problem for the quality of the precursors. The impregnated fibers show a tendency to cluster in bundles in the heater. The preferred configuration of the prepreg 32 is the array of fiber-matrix cluster, each cluster diameter ranging from that of a single fiber to multiple fibers (most cluster diameters are between 10–50 microns). In the heater, the coalescence of the polymer on the fibers goes through three steps: the heating up of fibers and the particles; interparticle sintering between adjacent particles until a film forms on the fiber surface; and, finally, the formation of a stable configuration of axisymmetric or non-symmetric droplets. In the first step, the temperature of the powder-impregnated fiber tow is raised by convection and radiation to a value greater than the melting or softening point of the polymer particles. Then, interparticle sintering begins with a neck formation between adjacent particles. The neck grows till the particles coalesce into one. Interparticle sintering time (defined to be the time when the interparticle bridge is equal to the particle diameter) is primarily influenced by the temperature, the polymer viscosity and the particle size. The work required for a shape change is equal to a decrease in surface energy. Interparticle sintering leads to the formation of a film which breaks up to form droplets on the fiber. The transition from a polymer film on the fiber surface to droplets is driven by the finite wetting abilities of most thermoplastics. These droplets are of varying shape and symmetry with respect to the fiber axis. The shape of these droplets changes with time to equilibrium configuration which can be axisymmetric or non-symmetric depending on droplet volume and the influence of gravitational forces. If in the case of a spread fiber tow in which the impregnated fibers are in intermittent contact with each other, capillary forces between adjacent fibers may make film formation thermodynamically favorable. The final configuration depends on interfiber distances and droplet sizes in addition to surface tension forces. Therefore, there are three ways to improve the quality of prepregs 32.

1) Improve the spreader 20 operation. Interfiber distances have to be larger to avoid the bonding of adjacent fibers by the droplets. It is advantageous to have good spreading so that individual fibers are exposed thereby reducing the average cluster diameter.

2) Use a particular polymer as the binder for a given fiber. Interparticle sintering and film formation are influenced by viscosity, surface tension and particle size of the polymer. Surface tension of most polymers lies between 20–50 dynes/cm whereas viscosity can vary by orders of magnitude. Hence there is an optimum polymer for a given fiber.

3) Control the temperature of the heater 31 and the speed of the fiber motion. For a given fiber-polymer system and a given speed of the fiber motion, interparticle sintering and the film formation are influenced only by the temperature of the heater. If the temperature is too low, interparticle sintering will not occur and the prepreg tape cannot be formed. On the other hand, if the temperature is too high, the droplets and fiber clusters will form, which is not desired for the production of the aluminum precursors. However, there are proper temperatures at which the interparticle sintering has occurred but the film has not formed completely. In this case, it is possible to get high quality of prepreg 32 because the particle sintering can hold fibers as prepreg tape by periodic fiber-to-fiber contact. In the metal powder coating chamber 20, a greater fraction of the fiber surface is exposed to the cloud of the fine metal powder before the sintering is completely finished.

Type B prepreg was an attempt to produce a better polymer dispersion. It is obvious that 165° C. is too low to be the best processing temperature because the sintering has not occurred for some nylon particles which will be lost during handling and the prepreg 32 cannot be formed. However, the mechanical property has shown the distinct improvement for type B prepreg 32.

Flexural strength and modulus of 335 MPa and 108 GPa for type A, 285 MPa and 74 GPa for type B were obtained when the precursors were vacuum hot pressed at 570° C. for 30 minutes under 30 MPa pressure. It corresponds to a value of 13% and 28% of the rule of mixtures strength, 71% and 66% of the rule of mixtures modulus, respectively. The lower measured strength and modulus may be due to several factors.

1) The distribution of the fibers in the composite was not always uniform, and this affected the maximum fracture load. Some areas had a high density of fibers and others had a low density. There are some fiber clusters (fiber-to-fiber contact) in the composite although type B prepreg 32 is better than type A prepreg 32. Fiber clusters in type B prepreg 32 were smaller than in type A prepreg 32. Thus a larger fraction of the fibers in type B prepreg 32 were completely surrounded by matrix. The micrographs of the fracture surface showed fiber pullout in the fiber cluster areas, which suggested that tow of fibers did not fully work as a reinforcement. The high magnification fractographs (FIGS. 19A and 19B) showed that where fibers were in direct contact with each other, the fracture in fibers started at the fiber-fiber interface. This suggests that fibers in direct contact lead to premature fracture. This can explain why the strength of type A prepreg 32 is less than the strength of type B prepreg 32 in terms of the percentage of the rule of mixtures. So it is the poor distribution of the fibers that mainly cause the lower strength.

2) The fiber coating with aluminum powders is uneven for type B prepreg 32, and this may affect the load transfer efficiency at the interface. As mentioned before, type B prepregs 32 were processed at 165° C. and some nylon powder particles were not as evenly distributed due to inadequate sintering at the lower processing temperature. This resulted in the existence of portions of the fibers without any coating. These uncoated regions resulted in some voids in the fiber-matrix interface, where the powder particles were not completely consolidated due to the fact that the pressure could not reach these regions during consolidation. The bonding in these regions is very poor because some unsintered aluminum powders can be found (Refer to FIG. 19B at arrow). Therefore, since some portions of the fibers cannot transfer elastic loading to the matrix, the stiffness of the composite is reduced. It is the uneven fiber coating that may cause the lower modulus of type B prepreg 32 than that of type A prepreg in terms of the percentage of the rule of mixtures. However, since the modulus values are close, they may also represent experimental variation.

3) The optimal consolidation parameters can be determined. Higher temperatures and longer times give lower strength because of brittle carbide formation at the interface of the aluminum and the carbon fibers. Lower temperatures and shorter times give lower strength due to poor bonding strength at the inter-aluminum matrix. The occurrence of low strength may be due to poor bonding strength of the aluminum matrix under higher pressures or damage of the reinforced fibers under high pressures. Therefore, the optional processing parameters are selected to get the maximum in strength of composite.

4) The matrix metal and the characteristics of the reinforcing component have important influence to the strength of the composite. As mentioned earlier, most aluminum matrix composites are produced by aluminum alloy. So the use of pure aluminum could be a factor because pure aluminum has lower strength and is more reactive than aluminum alloys. Regarding the reinforcing component, high modulus carbon fibers have a high content of crystallized carbon and good chemical stability but high cost because they were carbonized at 2000°–3000° C. In contrast high strength carbon fibers were carbonized at 1000°–1500° C., so these fibers are cheaper but more reactive with aluminum than high modulus carbon fibers. In view of the lower costs, the use of high strength carbon fibers, as described in this investigation, should be significant in the production of these composites although the strength is lower.

5) Increasing fiber volume fraction in the composite is a way to increase the strength of the composite. It is well established that the strength of composite is a function of fiber volume fraction in direct proportion. Hence reducing the time of aluminum powder fluidizing can increase the fiber volume fraction and the strength of composite.

6) Selecting a better polymer as the binder is another way to increase the strength of composite.

The binder plays a very important role in the new fabrication method of CFMMC. A good binder improves the distribution of the fibers and the matrix powder during the production of the precursors. It is more important that the binder not promote interfacial reactions. Therefore, the polymeric binder must fulfill a succession of requirements as it proceeds through the method steps.

1) It must be thermoplastic to be a binder at high temperature.

2) It must provide suitable viscosity and surface tension and flow properties.

3) It must be capable of being removed in vacuum furnace 40 by controlled pyrolysis without disrupting the particle arrangement.

4) It must have a suitable melting point temperature and be stable around the melting point temperature (Woodthorpe, J., et al., J. Mater. Sci. 24 1038 (1989).

5) It must not react with aluminum and carbon fibers at high temperature, so polymers without oxygen may be better.

The mechanisms of the pyrolytic removal of binder must be understood in order to understand the last requirement. There are three mechanisms for the pyrolytic removal of binder, which are evaporation, thermal degradation and oxidative degradation (Wright, J. K., et al., J. Am. Ceram. Soc. 72(10) 1822 (1989); and Edirishinghe, M. J., British Ceramic Proceedings, 45 45 (1990)). Evaporation is the dominant mechanism when low molecular weight waxes are used as the binder. Here the organic species do not undergo chain scission and are independent of the atmosphere used. Thermal degradation of the binder is carried out in an inert atmosphere where oxygen is absent. The decomposition of the polymer takes place entirely by thermal degradation processes by a free-radical reaction. The predominant process is the formation of lower-molecular-weight substances by intramolecular transfer of radicals, resulting in random chain scission and a reduction in molecular weight. Molecular fragments less than a critical size are lost by evaporation. The presence of oxygen during binder removal super impose on thermal degradation an additional reaction with polymer and metal powder. The reaction products may or may not be volatile substances.

Polyamide was used as the preferred binder, and it was believed to be removed completely by thermal degradation in the vacuum furnace. In fact, polyamide is not necessary the best choice as the binder for the C/Al system because it contains oxygen. It was mentioned earlier that the presence of oxygen catalyzes the formation of aluminum carbide at carbon/aluminum interfaces. Thermoplastic polymers such as polystyrene, polyethylene, polypropylene can be more suitable to be the binder because they fill the demand: thermoplastic, proper melting point, are removable, and are without oxygen. Selecting a suitable binder can be an effective method to improve the quality of composite.

The following conclusions were reached.

1) The method works well for the production of CFMMC. The spreading width is limited only by the length of the spreader over which the fiber tow passes and the spreader 12 width under a set of optimum conditions. However, the fibers tend to collapse to a narrow width after passing through the spreader, which needs to be corrected.

2) The fluidization of fine aluminum powder was successful by using the acoustic energy coming off a speaker 22 through rubber membranes 25. The aerosolizer is efficient with the uniform distribution of aluminum powder around the fibers.

3) Heating nylon-coated carbon fiber prepreg 32 to a temperature above the softening point of nylon created a sticky polymer host for fine aluminum powder. The perfect adhesion of aluminum powder to carbon fibers was achieved by making nylon serve as the binder. However, other polymers such as polystyrene, polyethylene, polypropylene can be more suitable binder for C/Al system because these polymers do not contain oxygen and are more easily volatilized.

4) The strength of the C/Al composite was lower than that expected from the rule of mixtures. It may be mainly attributed to the presence of fiber clusters due to imperfect fiber spreading.

EXAMPLE 2

The binder may not play an important role as seen from the micrographs of the prepregs 32 and aluminum precursors. This implies that the binder is not necessary since the electrostatic forces can make the aluminum powder stick to the carbon fibers. Without the binder, the fiber cluster does not form and the quality of composite can be improved.

Continuous processing of CFMMC by not using the polymer binder can also be accomplished. This is possible since metal powders form oxide coatings that can hold a static charge strong enough to attract the metal powder particle to the fiber and hold it in place long enough to be consolidated. This static attraction has been demonstrated in two ways: 1) powder aggregates are observed on the bottom of the aerosolizing chamber, indicating that the fine powder can hold a static charge and 2) as a result of hanging sections of bare carbon fiber tows in the aerosolizing chamber, the fibers were evenly coated with the powder.

Figure 20:
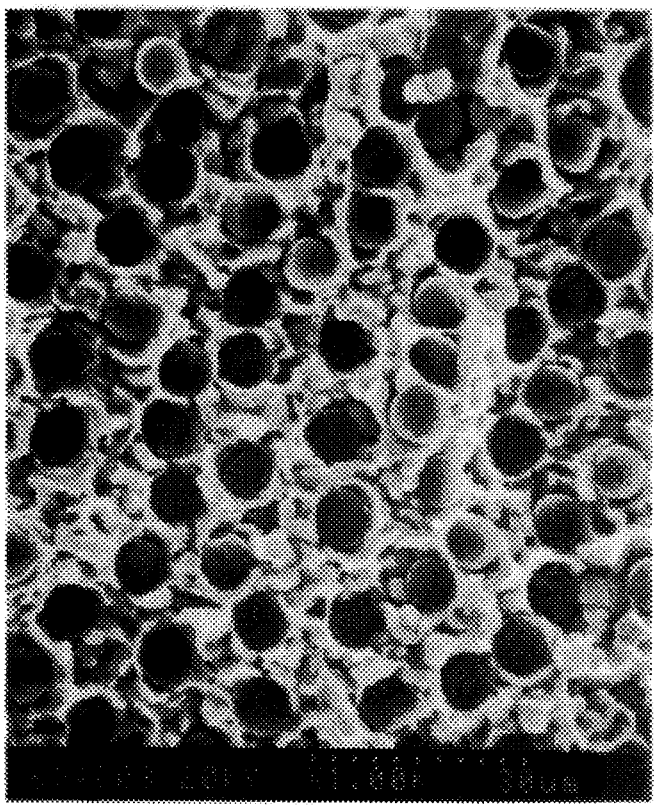
FIG. 20 is a SEM micrograph of a CFMMC of Example 2 showing uniform dispersion of the aluminum matrix around the fibers.

Subsequently, sections of bare fiber tows coated in this way were laid up in a stack and consolidated with minimum handling. Some layers that had lesser amounts of powder had additional powder sprinkled on top of the layer. These were consolidated in the conventional way by vacuum hot pressing. This sample had very evenly spaced fibers, with less than 2% of the fibers being in contact with each other in any particular cross section investigated. Some pullout of the fibers on the order of the fiber diameter was observed in the fracture surface of a bend specimen. The CFMMC cross-section is shown in FIG. 20. Since the polymer binder is not required the processing is less complex, since no vacuum burnout of the polymer using furnace 40 is needed.

The procedure involved in the production of aluminum powder coated prepreg precursors was 1) The prepreg tapes (bare carbon tows) were cut into 5 cm long pieces.

2) The prepreg tapes were suspended inside the metal tube 31A with spring clips as shown in FIG. 5.

3) The metal tube 31A was hung on the pins 24B inside the glass tube.

4) 5–8 gm of aluminum powder was deposited on the bottom membrane 25.

5) The inside tube 24 was fitted on the top of the flange 26.

6) The top membrane 25 was placed in position with the help of the o-ring.

7) All the electric wires and vacuum hoses were connected properly.

8) The aluminum lid 28 was placed on the outer tube 21.

9) The vacuum pump 61 was operated until the pressure inside the tube 24 was reduced to below 3 in Hg.

10) Argon was slowly introduced to one atmosphere (14.7 psig).

11) The frequency generator or speaker 22 and the power amplifier was turned on to fluidize the aluminum powder for approximately 5 minutes.

Additional powder was sprinkled on top of some layers that had lesser amounts of powder. The aluminum coated carbon fiber precursors were consolidated by vacuum hot pressing. The steps involved were:

1) Align dozens of prepreg layers in mats.

2) Chop off the aligned prepreg in 2 cm long and 1 cm wide pieces.

3) Wrap the prepreg with aluminum foil.

4) Apply boron nitride paste evenly on the inner surface of the fixture.

5) Place the sample in the fixture.

6) Put the fixture on the bottom platen inside the pressing furnace.

7) Press the top platen on the sample with pressure of a little more than zero.

8) Close the furnace and pump vacuum to less than $2\times10^{-5}$ Torr.

9) Increase the temperature to 570° C. in 30 minutes.

10) Press the sample under 30 MPa at 570° C. for 45 minutes.

11) Release the pressure and decrease the temperature to 400° C. in 5 minutes.

12) Extract the specimen after the furnace reaches room temperature.

The density and coefficient of thermal expansion "α" of the composite were measured. "α" was measured using a Dilatometer and Archimedes principle was used to measure the density. Mechanical properties of the Example 2 com posite were also measured by using United Testing System. The results are given in Table 6.

TABLE 6

Physical and Mechanical Properties of Example 2 Composite:
Density "p" - 2.28 gm/cm$^3$
Coefficient of Linear Thermal Expansion "α" – 1.793 × 10$^6$/°C.
Mecanical Properties of the Composite at Room Temperature

| Specimen | Sample 1* | Sample 2* |
|---|---|---|
| Span, mm | 18.0 | 18.0 |
| (in) | (0.71) | (0.71) |
| Width, mm | 2.90 | 3.12 |
| (in) | (0.114) | (0.123) |
| Thickness, mm | 0.57 | 0.025 |
| (in) | (0.022) | (0.635) |
| Yield Load, lb | N/A | N/A |
| Peak Load, lb | 4.731 | 4.598 |
| Yield Stress, psi | N/A | N/A |
| Flexural Strength, | 91324 | 63697 |
| psi | 629.68 | 439.19 |
| (MPa) | | |
| Flexural Modulus, psi | 14742630 | 12691180 |
| (GPa)* | 101.65 | 87.51 |
| % ROM Strength | 78.55 | 67.63 |
| Strain Failure (%) | 0.6554 | N/A |

For bending tests of composites, the span-to-depth ratio is recommended to be at least 16:1. This ratio shall be chosen such that failures occur in the outer fibers of the specimens, due only to the bending moment. For highly anisotropic composites, shear deflections can seriously reduce the modulus measurements. In this study, a ratio of 32:1 is a standard that should be adequate to obtain valid modulus measurements.

The consolidated sample was approximately 30 mm×12 mm×3 mm plate, that was cut into 2 mm wide specimens by a low speed diamond saw after the composite plate was trimmed off to eliminate unconsolidated materials at the edges.

For Alpha measurements, the original sample was cut into 25.4 mm×12.7 mm×3 mm block. The alpha value determined from the Dilatometer experiment is $1.793\times10^{-6}$/° C. and the density of the material is 2.28 gm/cm$^3$. The porosity of the material is found to be less than 1%. Fiber volume fraction was measured by counting the fibers observed on a composite cross section and it was around 40–50%.

FIGS. 23, 24, 25, 26, 27 and 28 show the optical micrographs of the transverse and longitudinal sections of the composite at different magnifications. From the FIG. 25, it was clear that there was no matrix material in one part of the specimen. This may account for the porosity determined from the density measurement.

Figure 26:
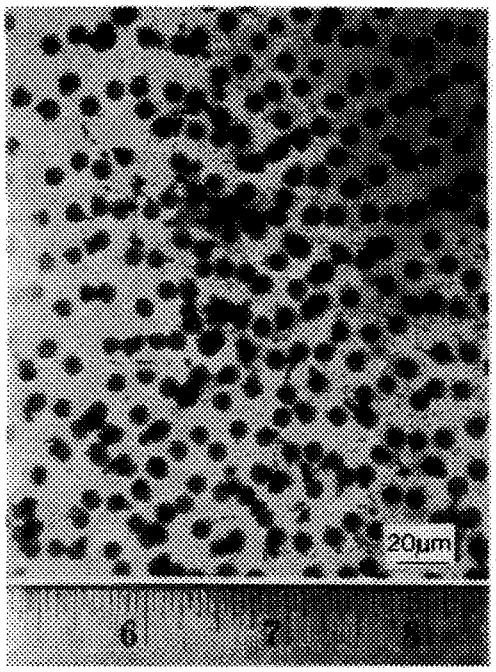

FIG. 26 shows the even distribution of fibers with very few fibers contacting each other. From these Figures, it is obvious that the fiber—matrix interface is smooth with no apparent discontinuity in the interface, even at higher magnifications. This implied that the fiber-matrix bonding is good with no interface reaction and no fiber damage. However, these micrographs show less than 2% of the fibers being in contact with each other in any particular cross section investigated. In addition, some fiber pull out on the order of the fiber diameter was observed in the fracture surface of a bend specimen. FIGS. 27 and 28 show the SEM fractographs of the composite of FIG. 16

Main features of this new fabrication technique are:

1) It was capable of picking up the desired volume fraction of metal matrix.

2) The distribution of the matrix around the fibers was uniform.

3) Micrographs showed that the fiber—matrix bonding was good.

4) The processing is less complex since the polymer binder is not required and no vacuum burnout of the polymer using furnace 40 is needed.

Figure 21:
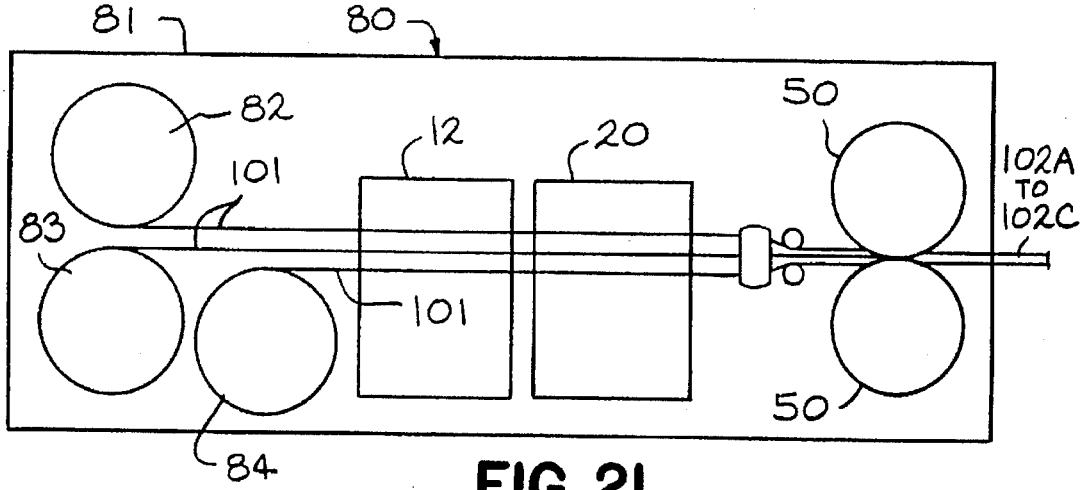
FIG. 21 is a schematic front view of a continuous processing system 80 for producing CFMMC products 102A to 102C having various cross-sections.
Figure 21A:
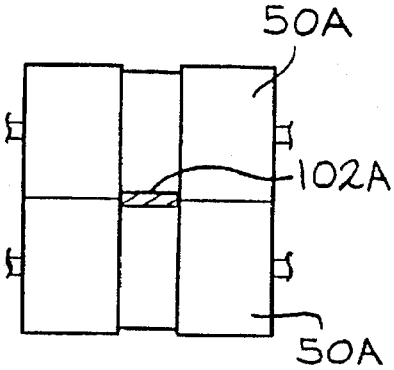
FIGS. 21A to 21C show various constructions for consolidation rolls 50 for producing the products 102A to 102C.
Figure 21B:
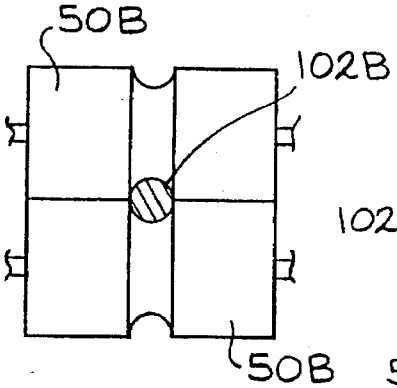
Figure 21C:
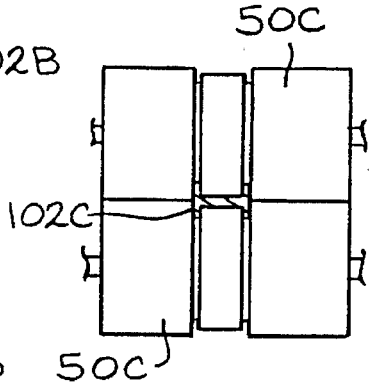

As shown in FIG. 21 for system 80, the fiber tow is spread in spreader 12, coated in the apparatus 20 with metal powder and then immediately pressed between heated rolls 50, such as rolls 50A, 50B and 50C, at the consolidation temperature in a condition that provides adequate pressure for sintering. The exit side of the rollers 50 provides a consolidated product, such as a foil or a wire or rod, as illustrated in FIGS. 21, 21A to 21C. The system 80 is enclosed in enclosure 81. The prepreg 101 is filled from spools 82, 83 and 84 to provide composites 102A, 102B or 102C. With more complicated roller geometry, more complex beam shapes can be fabricated. Thus the tows of fibers are coated simultaneously and guided to proper position at the consolidation rolls 50, so that larger thicknesses can be built up, or more complex shapes can be fabricated as shown in FIG. 21.

With a scalping operation on aluminum shapes occurring prior to the consolidating rolls, a thin coating of fiber reinforced material can be applied, as shown in FIG. 22. The system 90 is provided in an enclosure 91. The core 92 is scraped by cutters 93 and then the metal coated precursor is compressed onto core 92 by rollers 96. The prepreg 32 is fed from spools 94 and feed rolls 95. The product is composite 103.

The continuous fiber tows coated with polymer and matrix powders could be subsequently chopped for consolidation in desired geometries, and thus provide coated chopped fibers with evenly distributed matrix. In addition consolidated continuous fiber products made using the above procedures could be chopped for subsequent consolidation in desired geometries. In addition, chopped fibers could be coated with polymer and/or matrix powders to provide chopped coated fibers for subsequent consolidation.

It is intended that the foregoing description is only illustrative of the present invention and the present invention is limited only by the hereinafter appended claims.

We claim:

1. A method for forming a composite product which comprises:

(a) providing fibers coated with particles of an oxidizable metal containing powder wherein the fibers have been coated with the particles in a controlled atmosphere which prevents an uncontrolled oxidation of the particles; and (b) pressing the powder coated fibers in a heated press in a vacuum so that the particles of the metal containing powder consolidate with the fibers to form the composite product.

2. A method for forming a composite product which comprises:

(a) introducing a tow of fibers coated with beads of a polymer into a closed chamber containing particles of an oxidizable metal containing powder to be coated onto the fibers in a first controlled atmosphere which prevents uncontrolled oxidation of the metal containing powder;

(b) aerosolizing the powder in the chamber in the controlled atmosphere which prevents the uncontrolled oxidation of the metal containing powder so as to coat the particles on the polymer and fiber;

(c) removing the particle coated tow of fibers from the chamber; and (d) consolidating the particle coated tow of fibers in a heated press in a vacuum so that the metal containing powder sinters together and forms a matrix around the fibers to provide the composite product.

3. The method of claim 2 wherein the controlled atmosphere is a gas which is non-reactive with the metal containing powder.

4. The method of any one of claims 1, 2 or 3 wherein the fiber is carbon and the metal containing powder is aluminum.

5. The method of any one of claims 2 or 3 wherein the fiber is carbon and the metal containing powder is aluminum and wherein in step (d) the coated tow of fibers is consolidated in the heated press at a temperature between about 500° C. and 600° C. in the vacuum.

6. The method of any one of claims 2 or 3 wherein the polymer is nylon.

7. The method of any one of claims 2 or 3 wherein the polymer is nylon and wherein the tow of fibers coated with the polymer is heated to a temperature between about 150° and 250° C. to cause the polymer to become tacky prior to introducing the tow of fibers into the chamber.

8. The method of any one of claims 2 or 3 wherein the polymer is nylon, the metal containing powder is aluminum and fibers are carbon, wherein the polymer is heated at a temperature near its melting temperature to cause the polymer to become tacky prior to introducing the tow of fibers into the chamber and wherein in step (d) the coated tow of fibers is consolidated in a press at a temperature of between about 500° and 600° C. in the vacuum to form the composite product.

9. A method for forming a composite product which comprises:

(a) introducing a tow of fibers into a closed chamber containing particles of an oxidizable metal containing powder to be coated onto the fibers in a controlled atmosphere which prevents uncontrolled oxidation of the metal containing powder;

(b) aerosolizing the powder in the chamber in the controlled atmosphere so as to coat the particles on the fibers;

(c) removing the particle coated tow of fibers from the chamber; and (d) consolidating the particle coated tow of fibers in a heated press in a vacuum so that the metal containing powder sinters together and forms a matrix around the fibers to provide the composite product.

10. The method of claim 9 wherein the controlled atmosphere is a gas which is non-reactive with the metal containing powder.

11. The method of any one of claims 9 and 10 wherein the fiber is carbon and the metal containing powder is aluminum.

12. The method of any one of claims 9 and 10 wherein the fiber is carbon and the metal containing powder is aluminum and wherein in step (d) the coated tow of fibers is consolidated in the heated press at a temperature between about 500° C. and 600° C. in the vacuum.

13. The method of claim 1 wherein the fibers are chopped.

14. The method of any one of claims 1 or 2 wherein the metal powders are selected from the group consisting of Al, Ti, Cu, Be, Mg and alloys thereof.

15. The method of any one of claims 1 or 2 wherein the atmosphere is selected from the group consisting of argon, helium and nitrogen.

16. The method of any one of claims 1 or 2 wherein the atmosphere is argon.

17. The method of any one of claims 1 or 2 wherein the metal powders are selected from the group consisting of Al, Ti, Cu, Be, Mg and alloys thereof and wherein the atmosphere is selected from the group consisting of argon, helium and nitrogen.

18. A composite product produced by the method of claim 1.

19. A composite product produced by the method of claim 8.

20. A composite product produced by the method of claim 9.

21. A composite product produced by the method of claim 12.

* * * * *